US011190868B2

(12) United States Patent
Murarka et al.

(10) Patent No.: US 11,190,868 B2
(45) Date of Patent: Nov. 30, 2021

(54) ELECTROSTATIC ACOUSTIC TRANSDUCER UTILIZED IN A HEADPHONE DEVICE OR AN EARBUD

(71) Applicant: Massachusetts Institute of Technology, Cambridge, MA (US)

(72) Inventors: Apoorva Murarka, Cambridge, MA (US); Vladimir Bulovic, Lexington, MA (US); Jeffrey H. Lang, Sudbury, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 76 days.

(21) Appl. No.: 15/956,738

(22) Filed: Apr. 18, 2018

(65) Prior Publication Data

US 2018/0367884 A1 Dec. 20, 2018

Related U.S. Application Data

(60) Provisional application No. 62/486,922, filed on Apr. 18, 2017.

(51) Int. Cl.
*H04R 1/10* (2006.01)
*H04R 19/00* (2006.01)
(Continued)

(52) U.S. Cl.
CPC ..... *H04R 1/1091* (2013.01); *H04R 19/00* (2013.01); *H04R 19/005* (2013.01); *H04R 19/02* (2013.01);
(Continued)

(58) Field of Classification Search
CPC .... H04R 1/1091; H04R 19/00; H04R 19/005; H04R 19/02; H04R 25/505; H04R 25/554;
(Continued)

(56) References Cited

U.S. PATENT DOCUMENTS 4,266,263 A 5/1981 Haberl et al.
5,862,239 A 1/1999 Kubli et al.
(Continued)

FOREIGN PATENT DOCUMENTS

DE 10 2007-16995 A1 10/2008
JP 2000-067745 A 3/2000
(Continued)

OTHER PUBLICATIONS

U.S. Appl. No. 12/903,149, filed Feb. 24, 2015, Bulovic, et al.
(Continued)

*Primary Examiner* — Sean H Nguyen

(74) *Attorney, Agent, or Firm* — Spectrum IP Law Group LLC

(57) ABSTRACT

Briefly, in accordance with one or more embodiments, a headphone device, comprises at least one ear muff comprising a structure to hold the at least one ear muff against an ear of a user, and at least one driver disposed in the at least one ear muff. An earbud comprises an earbud housing having a protrusion to fit into an external acoustic meatus or ear canal of a user, and a driver disposed in the earbud housing. The driver comprises an electrostatic acoustic transducer comprising a substrate comprising a first material to function as a first electrode, a dielectric layer coupled with the first material, wherein the dielectric layer has one or more cavities formed therein, and a membrane coupled with the dielectric layer to cover the one or more cavities and to function as a second electrode.

34 Claims, 13 Drawing Sheets

(51) Int. Cl.

| | |
|---|---|
| ***H04R 31/00*** | (2006.01) |
| ***H04R 19/02*** | (2006.01) |
| ***H04R 25/00*** | (2006.01) |
| ***H04R 5/02*** | (2006.01) |
| ***H04R 5/033*** | (2006.01) |
| ***H04R 5/027*** | (2006.01) |

(52) U.S. Cl.
CPC ..... *H04R 25/505* (2013.01); *H04R 25/554* (2013.01); *H04R 31/00* (2013.01); *H04R 5/02* (2013.01); *H04R 5/027* (2013.01); *H04R 5/033* (2013.01); *H04R 2201/401* (2013.01); *H04R 2225/025* (2013.01); *H04R 2400/01* (2013.01); *H04R 2420/07* (2013.01)

(58) Field of Classification Search
CPC ..... H04R 31/00; H04R 5/02; H04R 5/027; H04R 5/033; H04R 2201/401; H04R 2225/025; H04R 2400/01; H04R 2420/07
USPC ..... 381/371
See application file for complete search history.

(56) References Cited

U.S. PATENT DOCUMENTS

| | | | | |
|---|---|---|---|---|
| 6,160,828 | A | 12/2000 | Kozlov et al. | |
| 6,243,474 | B1 | 6/2001 | Tai et al. | |
| 6,294,398 | B1 | 9/2001 | Kim et al. | |
| 6,444,400 | B1 | 9/2002 | Cloots et al. | |
| 6,472,962 | B1 | 10/2002 | Guo et al. | |
| 6,498,802 | B1 | 12/2002 | Chu et al. | |
| 6,586,763 | B2 | 7/2003 | Marks et al. | |
| 7,047,814 | B2 | 5/2006 | Zias et al. | |
| 7,305,890 | B2 | 12/2007 | Zias et al. | |
| 7,346,981 | B2 | 3/2008 | Borwick et al. | |
| 7,406,761 | B2 | 8/2008 | Jafri et al. | |
| 7,439,093 | B2 | 10/2008 | Beaudry | |
| 7,816,710 | B2 | 10/2010 | Palmateer et al. | |
| 7,836,574 | B2 | 11/2010 | Jafri et al. | |
| 7,893,919 | B2 | 2/2011 | Kothari et al. | |
| 8,087,152 | B2 | 1/2012 | Kato et al. | |
| 8,601,658 | B2 | 12/2013 | Bulovic et al. | |
| 8,739,390 | B2 | 6/2014 | Bulovic et al. | |
| 2002/0045105 | A1 | 4/2002 | Brown et al. | |
| 2004/0004988 | A1 | 1/2004 | Cok et al. | |
| 2004/0056244 | A1 | 3/2004 | Marcus et al. | |
| 2005/0230348 | A1 | 10/2005 | Kido | |
| 2006/0048885 | A1 | 3/2006 | Constantin | |
| 2006/0066640 | A1 | 3/2006 | Kothari et al. | |
| 2006/0177083 | A1 | 8/2006 | Sjursen et al. | |
| 2006/0186874 | A1 | 8/2006 | Mackin et al. | |
| 2008/0112570 | A1 | 5/2008 | Asada et al. | |
| 2009/0060233 | A1* | 3/2009 | Liou ..... | H04R 19/013 381/191 |
| 2009/0060234 | A1* | 3/2009 | Liou ..... | H04R 19/01 381/191 |
| 2009/0236310 | A1 | 9/2009 | Linder et al. | |
| 2009/0320274 | A1 | 12/2009 | Kato et al. | |
| 2010/0188796 | A1 | 7/2010 | Bulovic et al. | |
| 2010/0255426 | A1 | 10/2010 | Jain et al. | |
| 2010/0288635 | A1 | 11/2010 | Komiya et al. | |
| 2011/0129097 | A1* | 6/2011 | Andrea ..... | H04R 3/005 381/71.6 |
| 2011/0254107 | A1 | 10/2011 | Bulovic et al. | |
| 2012/0051556 | A1* | 3/2012 | Pompei ..... | G10K 15/02 381/77 |
| 2013/0221453 | A1 | 8/2013 | Dehe | |
| 2013/0249138 | A1 | 9/2013 | Desimone et al. | |
| 2014/0054732 | A1 | 2/2014 | Murarka et al. | |
| 2017/0094427 | A1 | 3/2017 | Higgins et al. | |
| 2017/0208565 | A1 | 7/2017 | Lowe et al. | |
| 2018/0050900 | A1 | 2/2018 | Duffy | |
| 2018/0302726 | A1 | 10/2018 | Koymen | |

FOREIGN PATENT DOCUMENTS

| | | | |
|---|---|---|---|
| JP | 2003-515887 | A | 5/2003 |
| JP | 2005/310387 | A | 11/2005 |
| KR | 10-2007-0011253 | A | 1/2007 |
| WO | 2003/073164 | A2 | 9/2003 |
| WO | 2004/107403 | A2 | 12/2004 |
| WO | 2007/074404 | A2 | 7/2007 |
| WO | 2008/133942 | A9 | 11/2008 |
| WO | 2009/096419 | A1 | 8/2009 |
| WO | 2009/120394 | A3 | 10/2009 |
| WO | 2010/017441 | A2 | 2/2010 |
| WO | 2010/028390 | A2 | 3/2010 |
| WO | 2010/075012 | A2 | 7/2010 |
| WO | 2013/033032 | A2 | 3/2013 |

OTHER PUBLICATIONS

Yu, et al., "Micropatterning Metal Electrode of Organic Light Emitting Devices Using Rapid Polydimethylsiloxane Lift-Off," Magazine, Jul. 23, 2007, 3 pages, 043102, Applied Physics Letters.
International Search Report and Written Opinion received for International Application No. PCT/US2012/052549, dated May 28, 2013.
Kim, et al. "Characterization of Aligned Wafer-Level Transfer of Thin and Flexible Parylene Membranes," Journal, Dec. 2007, pp. 1386-1396, vol. 16, No. 6, Juounal of Microelectromechanical Systems.
International Preliminary Report on Patentability received for International Application No. PCT/US2012/052549, dated Mar. 4, 2014, 9 pages.
International Search Report and Written Opinion received for International Application No. PCT/US2010/052403, dated Jun. 16, 2011.
Meitl, et al., "Transfer Printing by Kinetic Control of Adhesion to an Elastometric Stamp," journal, Jan. 2006, pp. 33-38, vol. 5, Nature Material Nature Publishing Group, UK.
International Preliminary Report on Patentability received for International Application No. PCT/US2009/030151, dated Oct. 6, 2009.
International Preliminary Report on Patentability received for International Application No. PCT/US2009/053086, dated Feb. 8, 2011.
International Search Report and Written Opinion received for International Application No. PCT/US2009/056267, dated Mar. 29, 2010.
International Search Report and Written Opinion received for International Application No. PCT/US2009/067801 dated Dec. 10, 2010.
International Preliminary Report on Patentability received for International Application No. PCT/US2010/052403, dated Apr. 17, 2012.
International Search Report and Written Opinion received for International Application No. PCT/US2009/030151, dated Oct. 6, 2009.
International Search Report and Written Opinion received for International Application No. PCT/US2009/053086, dated Mar. 19, 2010.
International Preliminary Report on Patentability received for International Application No. PCT/US2009/056267, dated Mar. 8, 2011.
International Preliminary Report on patentability received for International Application No. PCT/US2009/067801 dated Jun. 21, 2011.

* cited by examiner

ELECTROSTATIC ACOUSTIC TRANSDUCER UTILIZED IN A HEADPHONE DEVICE OR AN EARBUD

CROSS-REFERENCE TO RELAYED APPLICATIONS

The present application claims the benefit of U.S. Provisional Application No. 62/486,922 filed Apr. 18, 2017. Said Application No. 62/486,922 is hereby incorporated herein by reference in its entirety.

BACKGROUND

This application relates to a method, system and apparatus for acoustic devices. Contact-transfer printing enables additive, large-area fabrication of mechanically-active membranes of various thicknesses including nano-scale thicknesses ("nanomembranes") that can be integrated effectively, and with viable yields, into existing microelectronics fabrication processes and with other large-area processes for micro- and nano-structuring of substrates of various material sets and areas. When combined, these processes initiate a class of micro and nanoelectromechanical devices (MEMS/NEMS) not limited by today's integrated circuit (IC) based semiconductor material set, associated fabrication processes, and standard wafer substrate sizes. This specification encompasses scalable fabrication processes for suspended mechanically-active nanomembranes and accompanying micro- and nanostructured substrates, and targeted applications in acoustics and ultrasonics.

Micro- and nanoelectromechanical systems (MEMS/NEMS) form a nascent field that branched out of semiconductor IC manufacturing about three decades ago. Although MEMS devices are becoming ubiquitous with the advent of smartphones, tablets, wearables, and portable computing, these devices are developed and manufactured on a very narrow platform comprising of IC (integrated circuit) fab material sets and design parameters and are often limited in function. Hence, in order to expand the application space of MEMS/NEMS, it is essential that novel MEMS/NEMS material platforms are considered and developed. Moving away from the current IC-only platform would enable novel functionalities (discussed in greater detail below) and decrease the technological threshold that needs to be crossed to achieve such functions in MEMS/NEMS.

Suspended thin films provide a compelling approach to implementing several sensing and actuation functions at the micro and nanoscale. Thin films with thicknesses on the order of micrometers (microns) to hundreds of microns have been utilized in a variety of applications in microelectronic devices, including MEMS. However, when used as mechanically active elements, these films have been selected from a small and limited set of materials that includes silicon, polysilicon, silicon nitrides and other IC-based materials that have similar Young's modulus, Poisson's ratio and thermal expansion coefficients. Commercially, mechanically-active thin film devices have found ubiquity only in a limited number of applications such as MEMS microphones in smartphones, tablets, Bluetooth headsets, and smart home peripherals. Other high-volume MEMS sensor and actuator technologies currently used are gyroscopes, accelerometers and digital light projection systems, but, instead of utilizing mechanically-active modes of thin films, these devices rely on bulk micro-machined proof masses, springs, anchors, mirrors, and hinges, often involving several fabrication mask steps which, in turn, correlates to higher manufacturing complexity and cost, and lower yields. Moreover, in the process of miniaturization, wherever mechanical displacement and strain has been a desired device function (for example, ultrasound transducers, acoustic tweeters, microphones), mechanically-active thin film elements have often been overlooked and substituted with other materials such as electrets, magnetic systems, and piezoceramics. Piezoceramic, electret, and bulk magnetic devices are often fabricated and prepackaged before being integrated as discrete components on IC boards, thereby increasing manufacturing and assembly complexity.

DESCRIPTION OF THE DRAWING FIGURES

Claimed subject matter is particularly pointed out and distinctly claimed in the concluding portion of the specification. However, such subject matter may be understood by reference to the following detailed description when read with the accompanying drawings in which:

Figure 1:
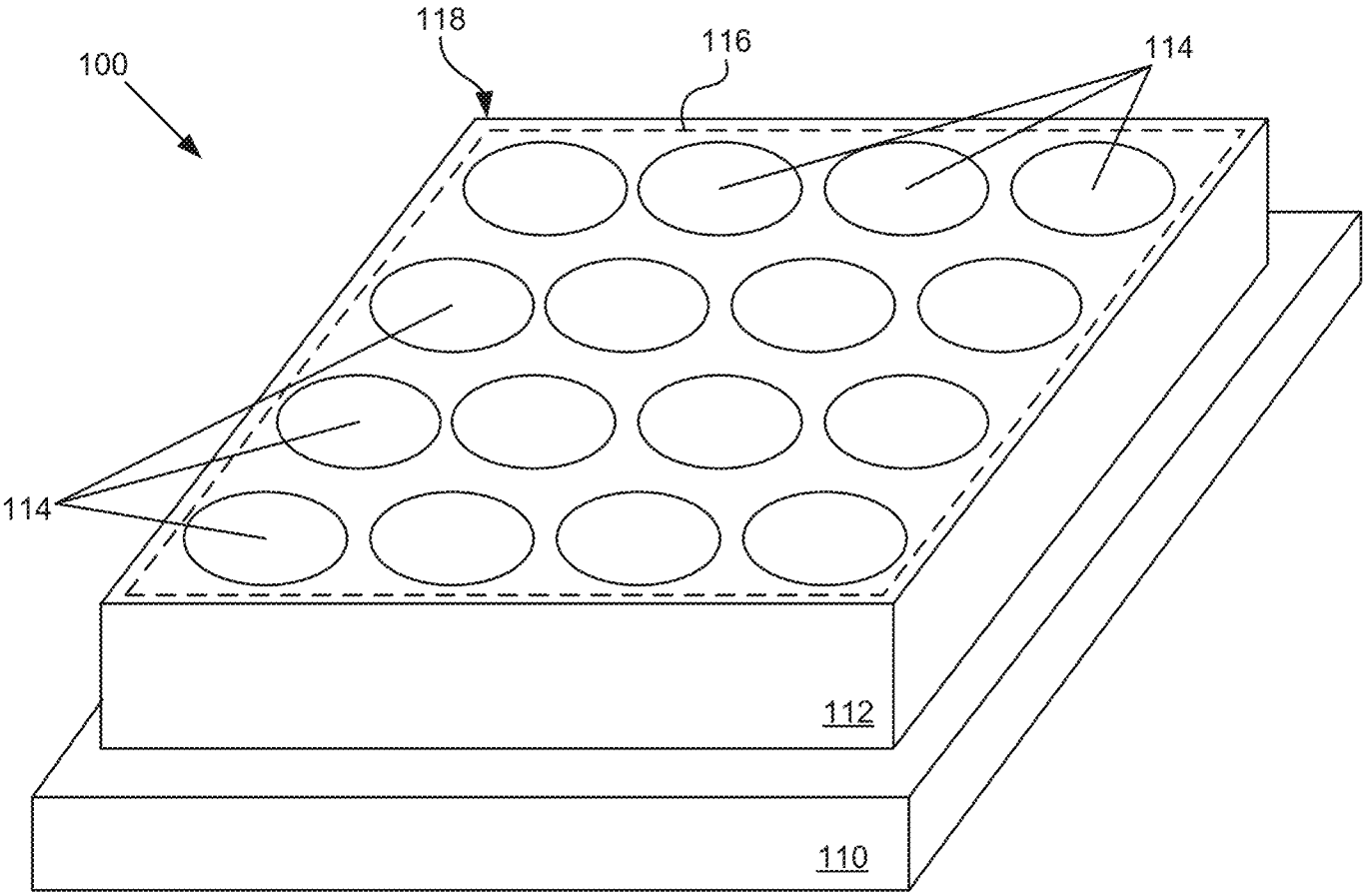
FIG. 1 is an isometric view of an electrostatic transducer in accordance with one or more embodiments.
Figure 2:
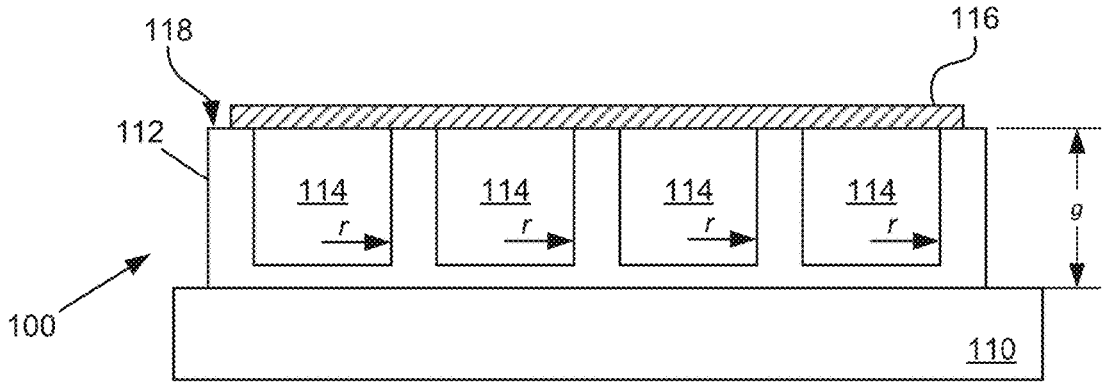
FIG. 2 is an elevation view of the electrostatic transducer of FIG. 1 in accordance with one or more embodiments.
Figure 3:
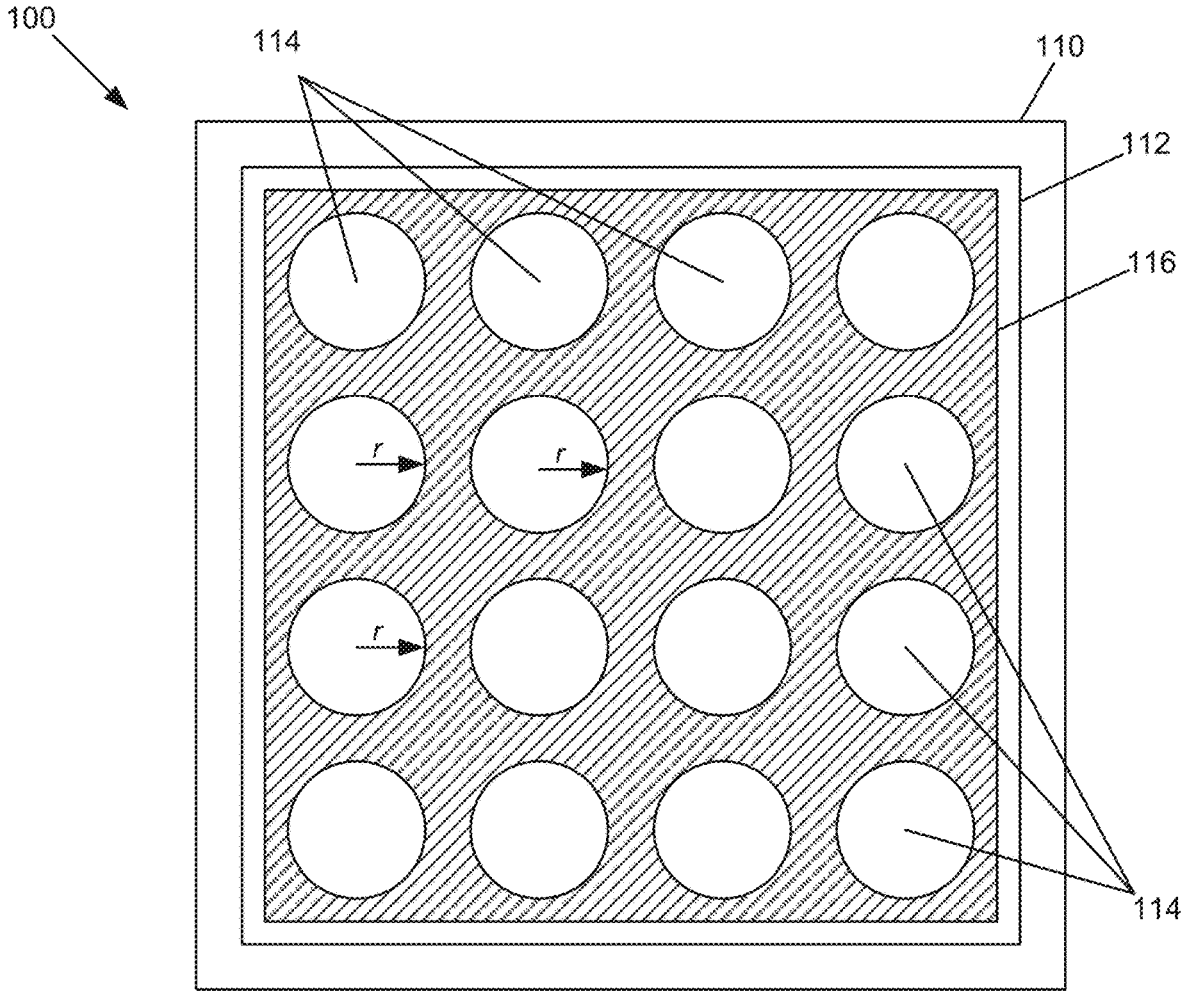
Figure 4:
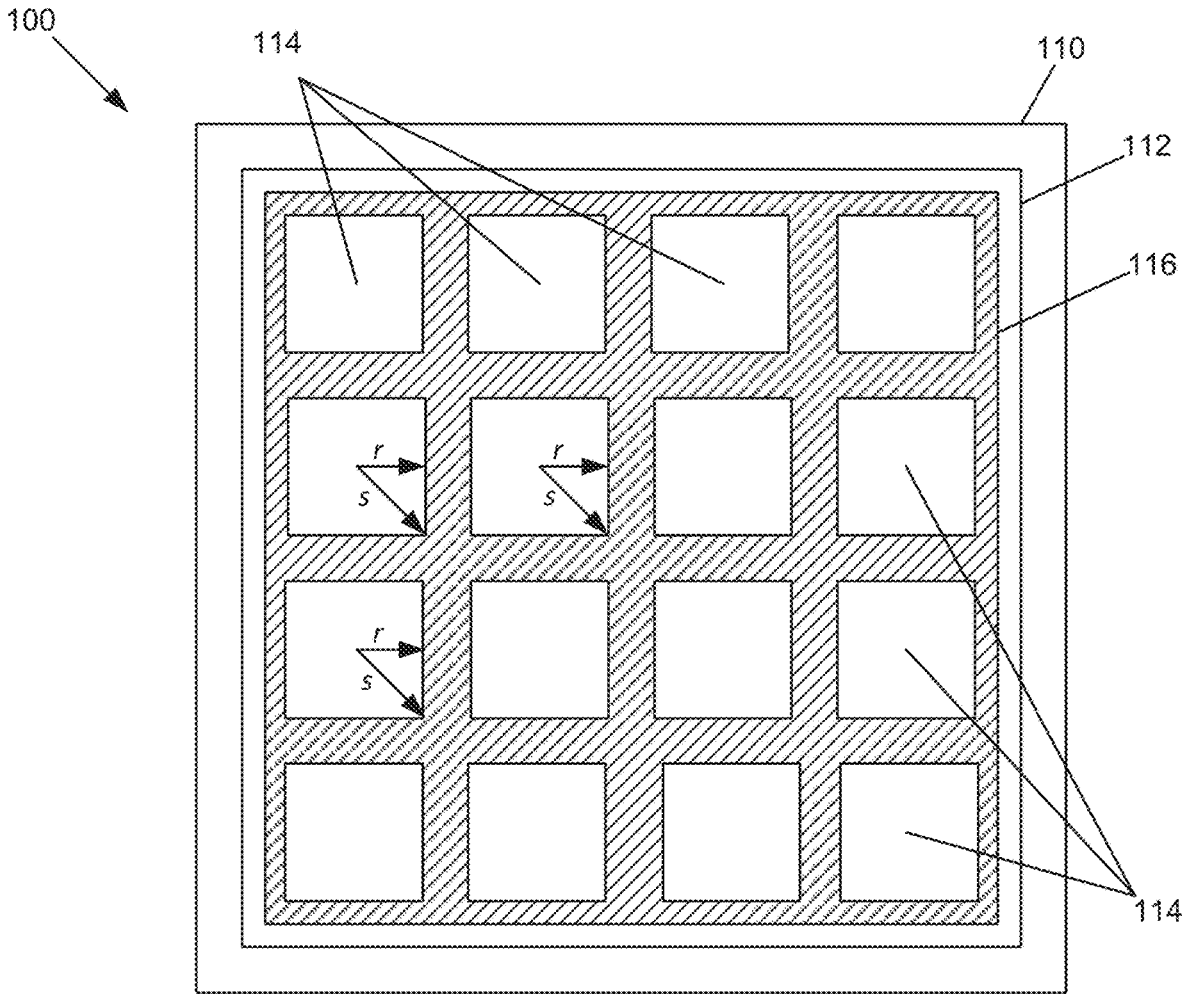
Figure 5:
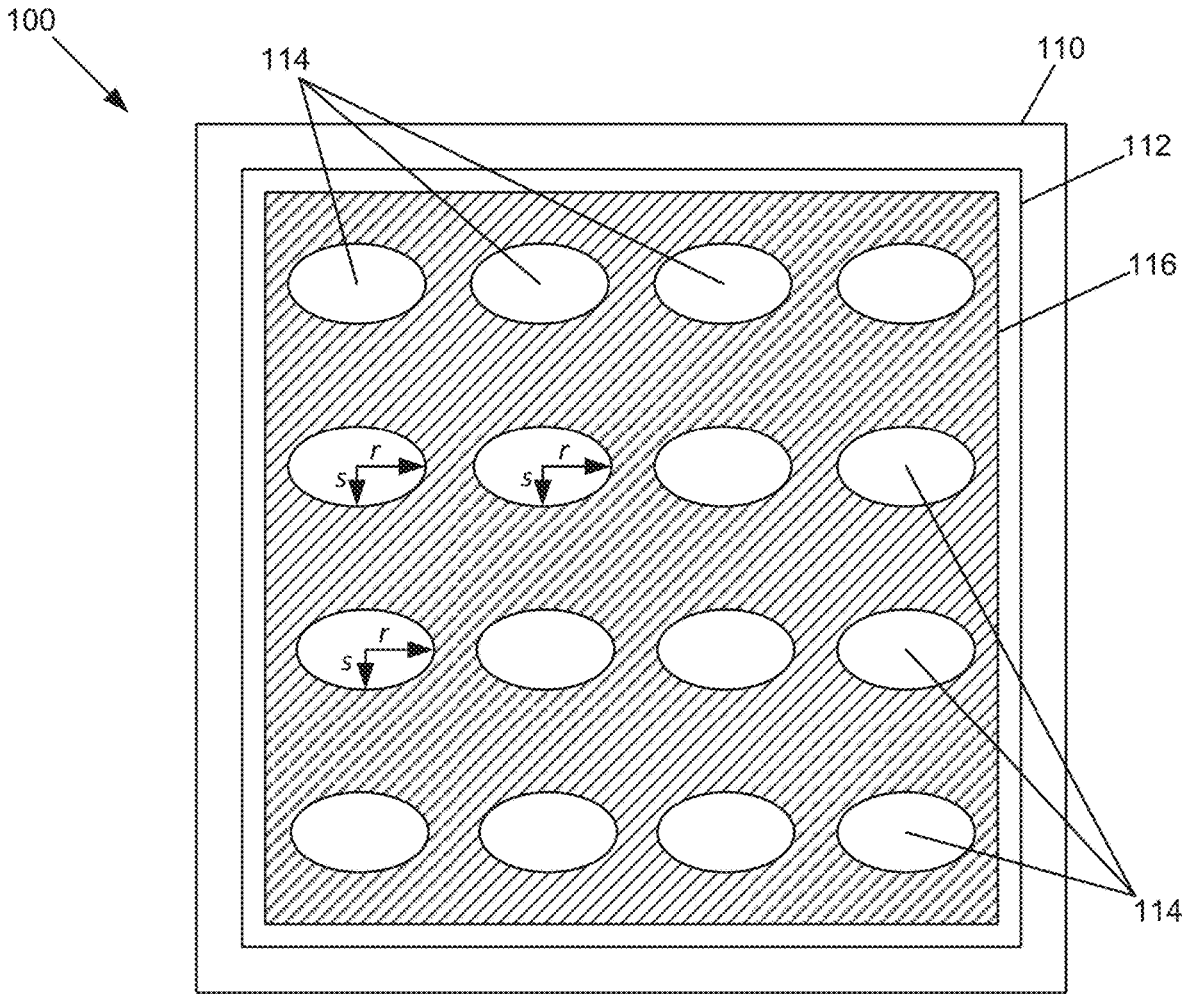
Figure 6:
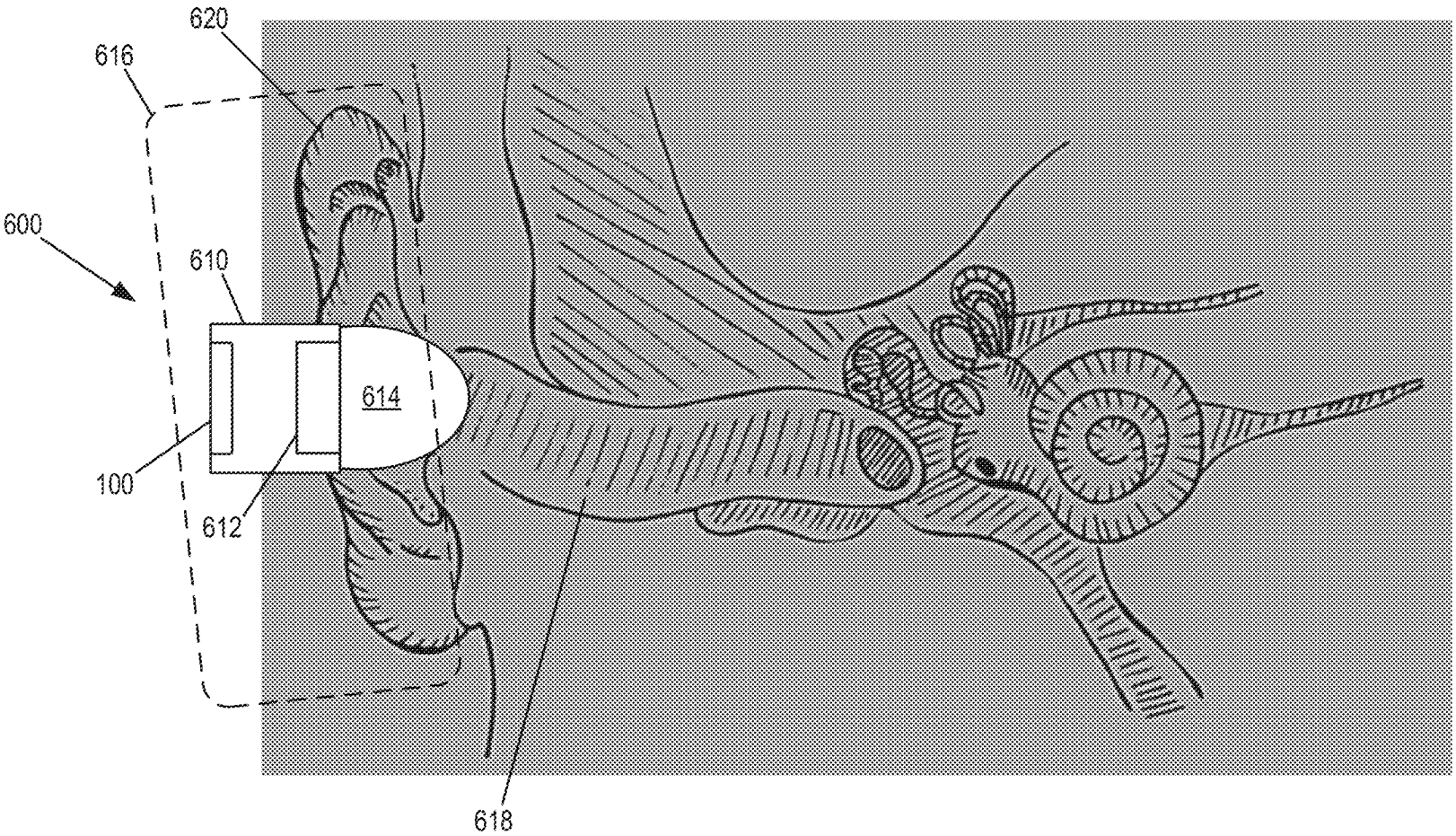
Figure 7:
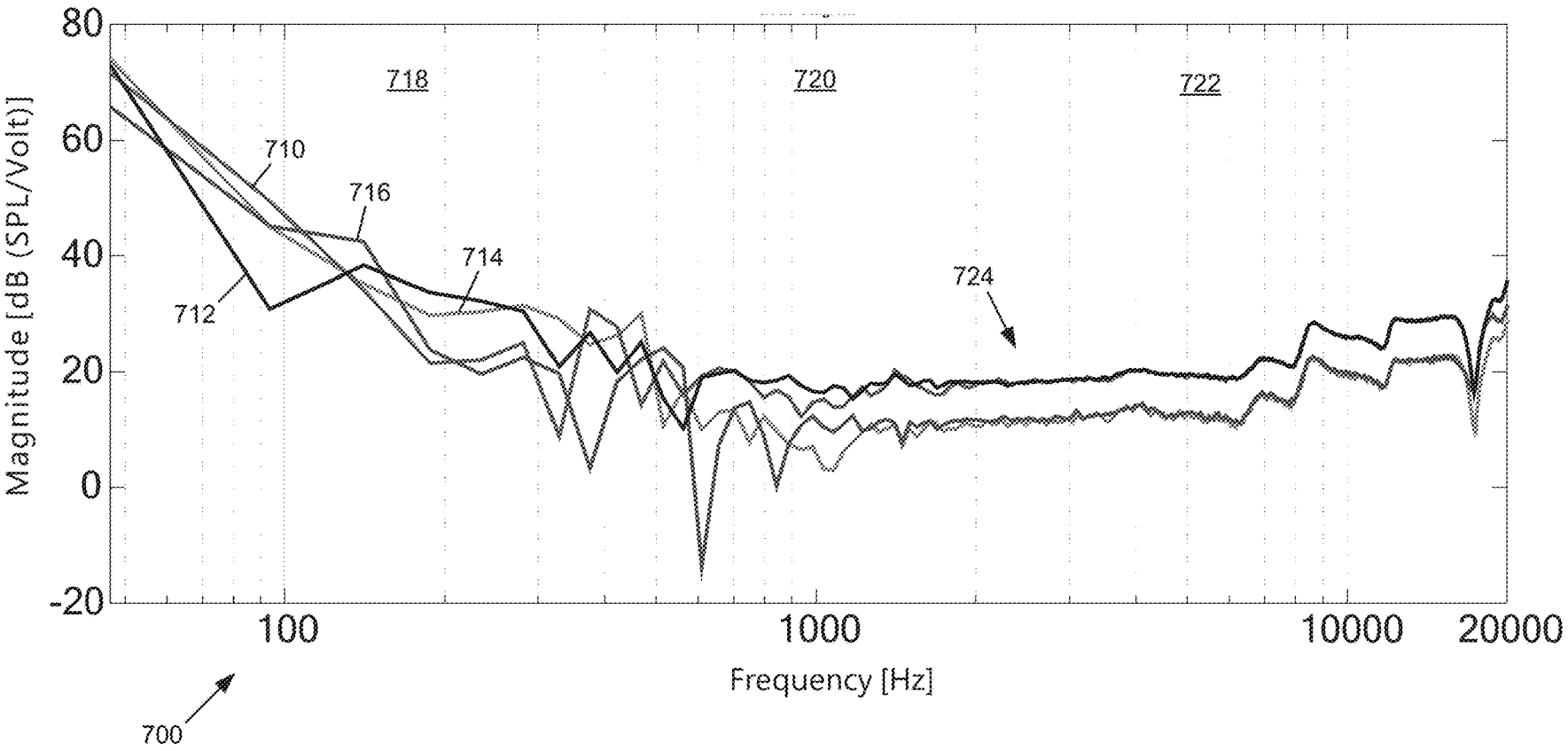
Figure 8:
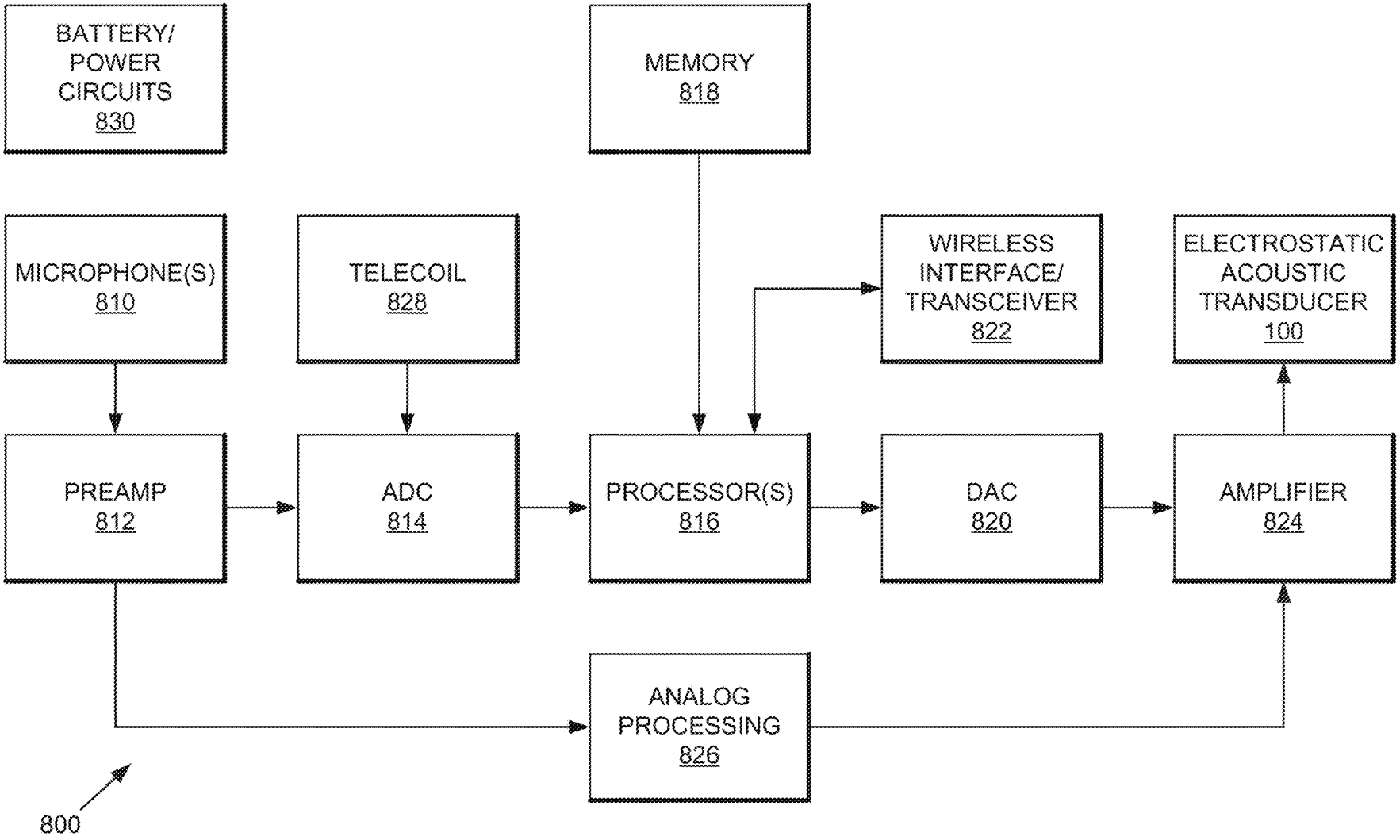
Figure 9:
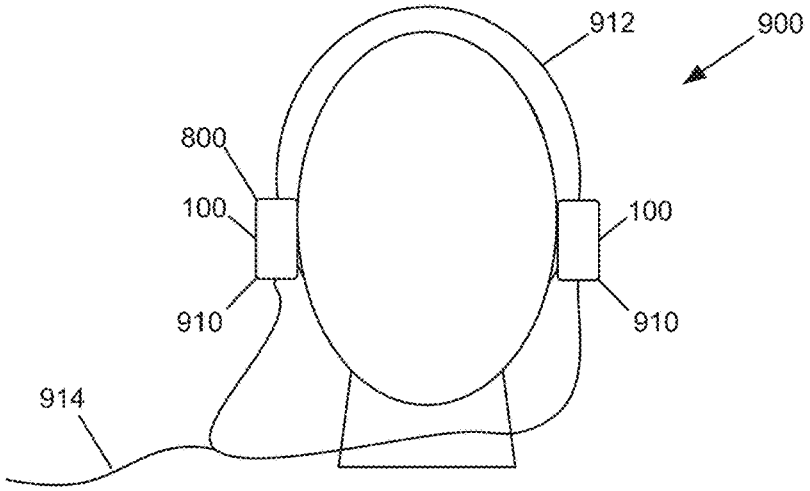
Figure 10:
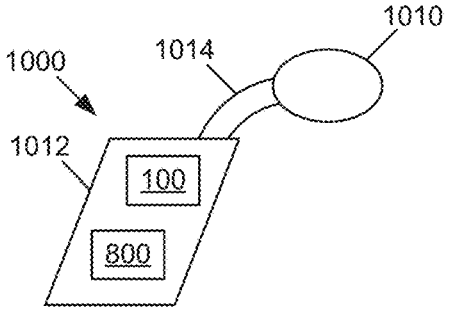
Figure 11:
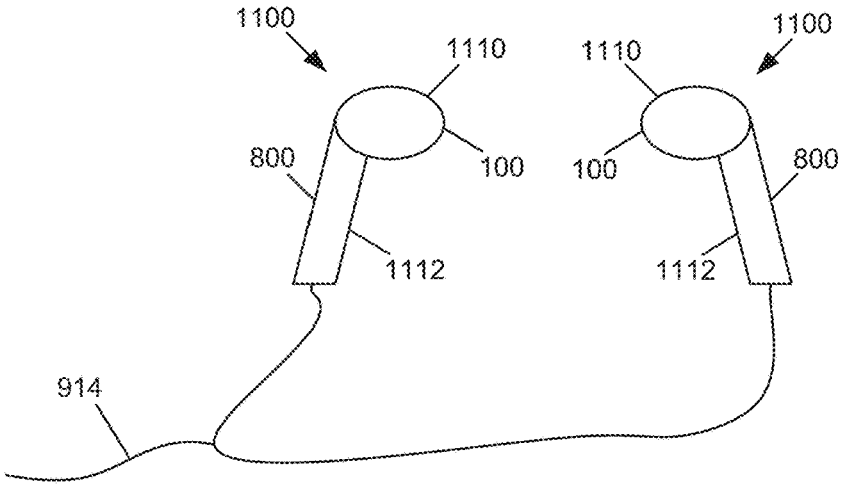
Figure 12:
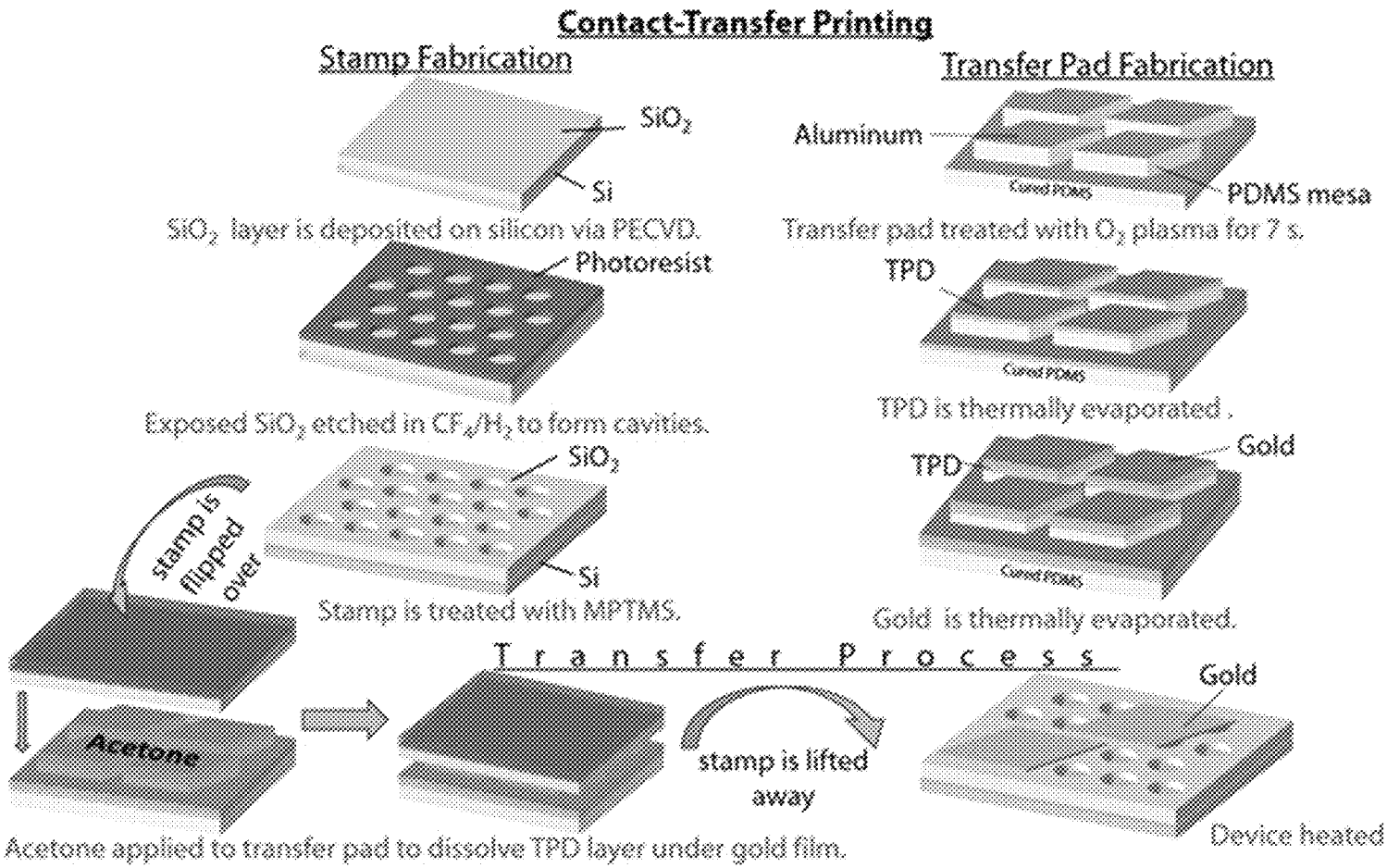
Figure 13:
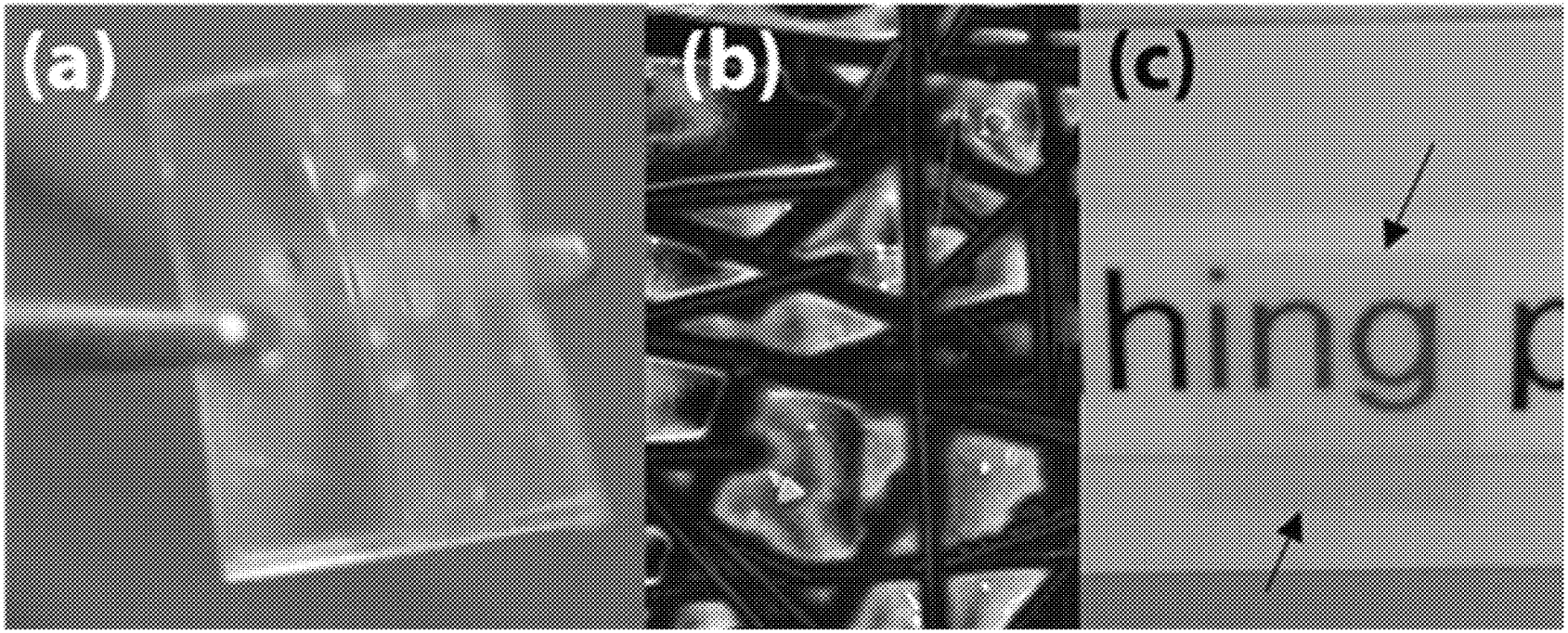
Figure 14:
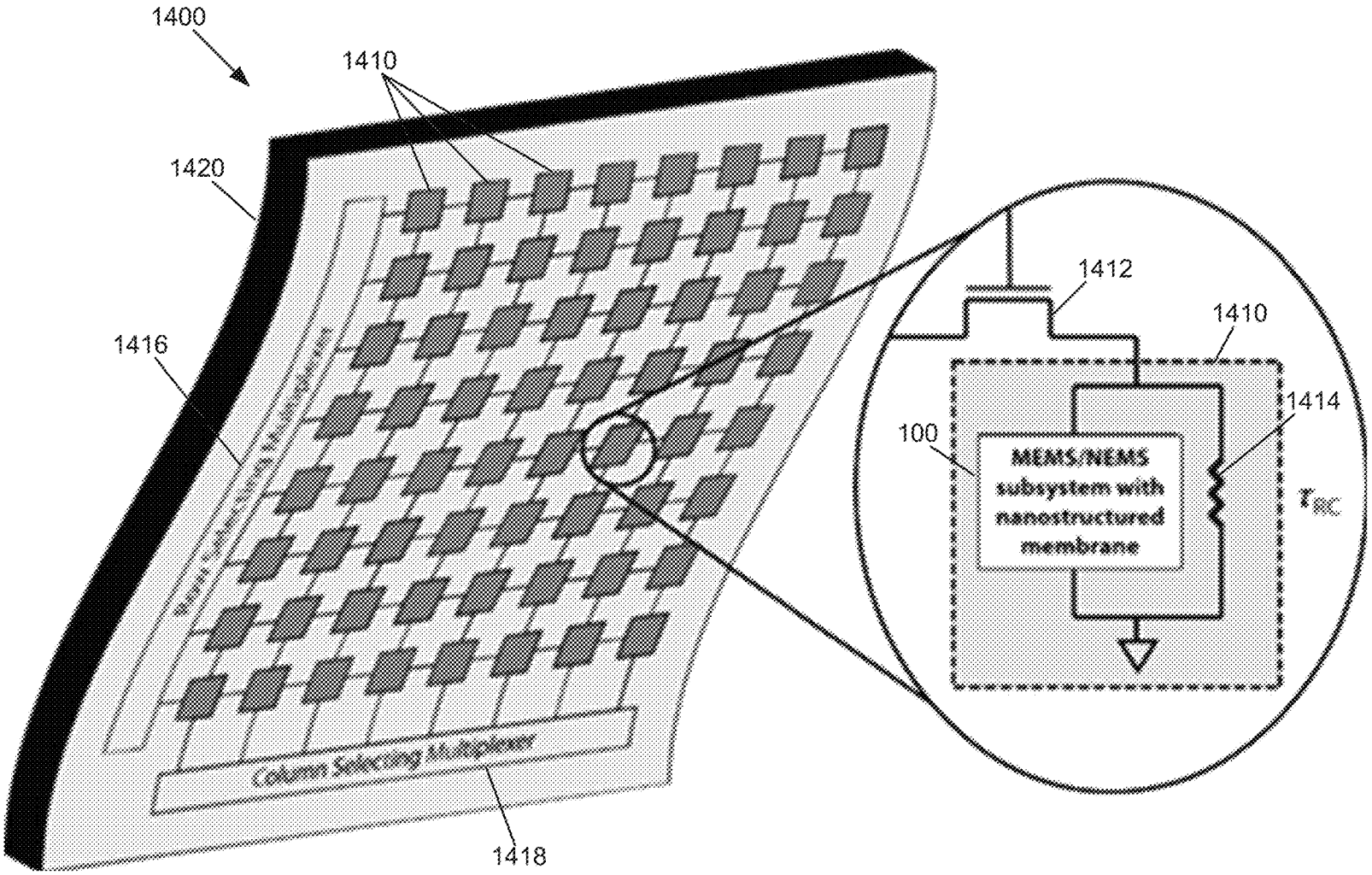
Figure 15:
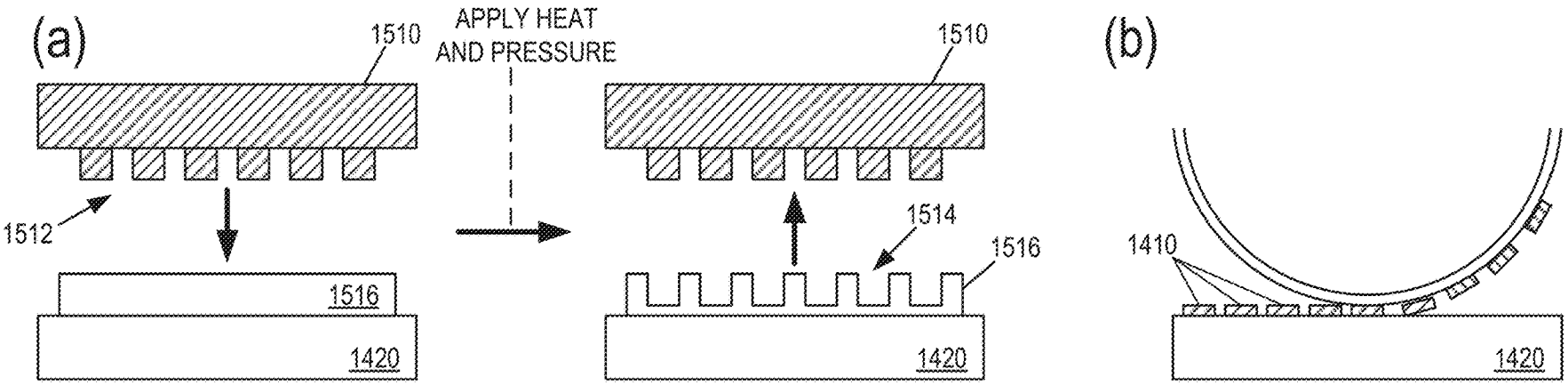
Figure 16:
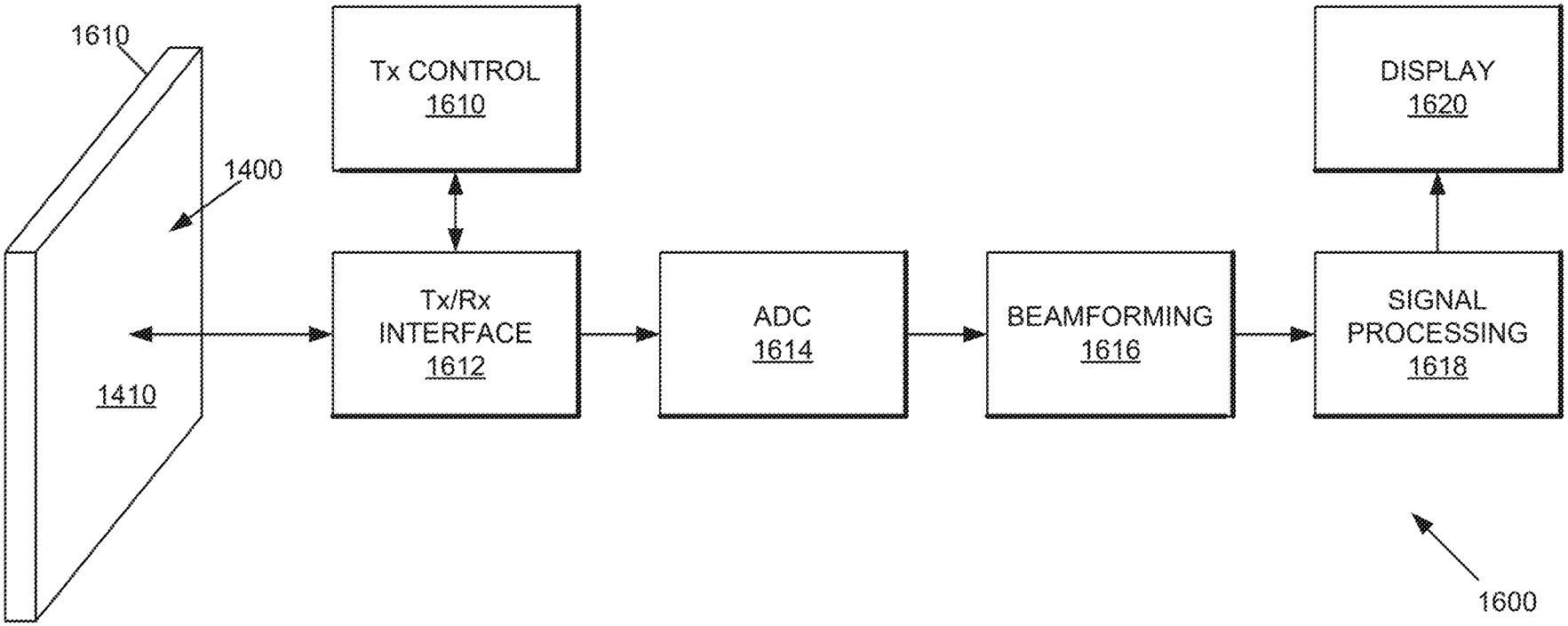

FIG. 3, FIG. 4, and FIG. 5 are top plan views of the electrostatic transducer of FIG. 1 and FIG. 2 in accordance with one or more embodiments;

FIG. 6 is a diagram of an ear canal coupling structure in accordance with one or more embodiments;

FIG. 7 is a graph of the frequency response of the electrostatic microspeaker of FIG. 2 and FIG. 3 in accordance with one or more embodiments;

FIG. 8 is a block diagram of an example architecture for an electronic device that utilizes the electrostatic acoustic transducer of FIG. 2 and FIG. 3 in one or more embodiments;

FIG. 9 is a diagram of an example headphone device that utilizes an electrostatic acoustic transducer in accordance with one or more embodiments;

FIG. 10 is a diagram of an example hearing aid or a personal sound amplification product (PSAP) device that utilizes an electrostatic acoustic transducer in accordance with one or more embodiments;

FIG. 11 is a diagram of one or more earbuds that utilize an electrostatic acoustic transducer in accordance with one or more embodiments;

FIG. 12 is a diagram of an example contact-transfer printing process to fabricate an electrostatic transducer to be utilized in an electrostatic microspeaker or in an electrostatic acoustic transducer in accordance with one or more embodiments;

FIG. 13 is a diagram of example transparent and flexible thin film materials for large area scalable sensors and actuators in accordance with one or more embodiments;

FIG. 14 is a diagram of an array of nanomembranes on an arbitrary-area flexible substrate with patterned electrodes, spacer layers, and electronics for addressing the nanomembranes in accordance with one or more embodiments;

FIG. 15 is a diagram of large area substrate nanostructuring and additive membrane deployment techniques in accordance with one or more embodiments; and FIG. 16 is an example architecture of an ultrasound system that utilizes an array of nanomembranes in an ultrasound transducer in accordance with one or more embodiments.

It will be appreciated that for simplicity and/or clarity of illustration, elements illustrated in the figures have not necessarily been drawn to scale. For example, the dimensions of some of the elements may be exaggerated relative to other elements for clarity. Further, if considered appropriate, reference numerals have been repeated among the figures to indicate corresponding and/or analogous elements.

DETAILED DESCRIPTION

In the following detailed description, numerous specific details are set forth to provide a thorough understanding of claimed subject matter. It will, however, be understood by those skilled in the art that claimed subject matter may be practiced without these specific details. In other instances, well-known methods, procedures, components and/or circuits have not been described in detail.

In the following description and/or claims, the terms coupled and/or connected, along with their derivatives, may be used. In particular embodiments, connected may be used to indicate that two or more elements are in direct physical and/or electrical contact with each other. Coupled may mean that two or more elements are in direct physical and/or electrical contact. Coupled, however, may also mean that two or more elements may not be in direct contact with each other, but yet may still cooperate and/or interact with each other. For example, "coupled" may mean that two or more elements do not contact each other but are indirectly joined together via another element or intermediate elements. In one or more embodiments, coupled may mean that two or more elements are chemically bonded, supported, one element is grown or seeded on the other for example via oxidation, one element is deposited on the other via chemical vapor deposition, or one element is spun on the other, and so on. Finally, the terms "on," "overlying," and "over" may be used in the following description and claims. "On," "overlying," and "over" may be used to indicate that two or more elements are in direct physical contact with each other. It should be noted, however, that "over" may also mean that two or more elements are not in direct contact with each other. For example, "over" may mean that one element is above another element but not contacting each other and may have another element or elements in between the two elements. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect. In the following description and/or claims, the terms "comprise" and "include," along with their derivatives, may be used and are intended as synonyms for each other.

Referring now to FIG. 1, an isometric view of an electrostatic transducer in accordance with one or more embodiments will be discussed. As shown in FIG. 1, in one embodiment electrostatic transducer 100 comprises a first electrode 116 comprising a 100-nm-thick gold membrane electrode of 100 square millimeter ($mm^2$) area suspended over a second electrode 110 comprising silicon substrate functioning as a second electrode or counter electrode. In some embodiments, the first electrode 116 may comprise a nanomembrane. An exemplary nanomembrane would be about 50 nanometers (nm) to about 150 nm thick and would have areas ranging from a few micrometers squared to about 100 square millimeters ($mm^2$) or even 1000 $mm^2$ and larger. Other exemplary ranges for nanomembrane thicknesses include about 30 nm to about 100 nm, and up to about 200 nm. Other nanomembranes such as single-layer graphene membranes or multi-layer graphene membranes or other single-layered or multi-layered 2D material membranes may be as thick (or thin) as just a single atom or a few atoms. Other exemplary ranges for the nanomembrane areas include about 50 $mm^2$, about 100 $mm^2$, less than 200 $mm^2$, and less than 100 square centimeters ($cm^2$), although the scope of the claimed subject matter is not limited in this respect.

The substrate may comprise a material such as silicon or highly-doped silicon to function as an electrode of the electrostatic transducer 100. The first electrode 116 is disposed on a surface 118 of a dielectric layer 112 comprising for example a silicon dioxide layer of thickness g and with an array or pattern of periodic etched cavities 114, also referred to as pits or recesses, having a radius r.

One or more nanomembranes comprising one or more of first electrode 116 may be suspended over the cavities 114 in the dielectric layer 112 of the electrostatic acoustic transducer 100. The cavities 114 in the dielectric layer 112 may vary in depth from 100 nm or less to about 6 micrometers. Cavity depth also may be as large as about 10 micrometers. Cavity depth also may be between about 300 nm to about 3 micrometers. The radius of the cavities 114 in the dielectric layer 112 of the electrostatic acoustic transducer 110 may vary from about 10 micrometers (microns) to about 200 micrometers. The radius also may be as large as about 1 mm or as small as about one half a micrometer. In some exemplary embodiments, the radius may be between about 25 micrometers to about 100 micrometers. The cavity radius ranges stated here also may apply to cavities of non-circular shapes with an equivalent half-width, or half-diagonal, or half-length. In an exemplary embodiment of the electrostatic acoustic transducer 100 with a 100 nm thick gold membrane of 100 mm2 area, the cavities 114 in the dielectric layer 112 may have a depth of about 3 micrometers and a radius of about 100 micrometers, although the scope of the claimed subject matter is not limited in this respect.

In some embodiments, the cavities 114 may be square shaped, rectangular shaped, elliptical shaped, from the top plan view, or may be cone shaped, pyramid shaped, frustum shaped, or in general may have sloping sidewalls from an elevation view, and the scope of the claimed subject matter is not limited in this respect. Some examples of such embodiments are shown in FIG. 4 and in FIG. 5. In such embodiments, the cavities may have a half-width or side length across the shorter span or the longer span analogous to a radius of a circle, and the scope of the claimed subject matter is not limited in this respect. The first electrode 116 and the second electrode or counter electrode 110 may be separated by the dielectric layer 112 and together form a capacitive type device that is capable of functioning as an electrostatic transducer such as a microphone or a speaker. In one or more embodiments, at least one or more of the cavities 114 may be connected to each other through their shared walls (not shown) to provide a path for air relief upon deflection of the membrane into one or more of the cavities 114. The cavities 114 may define one or more sidewalls and/or one or more bottoms in the dielectric layer 112. In some embodiments, an insulator layer (not shown) may cover at least a portion of one or more of the sidewalls and/or the bottoms of the cavities 114 and/or the surface 118 of a dielectric layer 112 wherein the insulator may function to prevent electrical shorting of the substrate (and/or the counter electrode) and the membrane. The cavities 114 may be of varying sizes or radii and/or depths on the same substrate die or may be disposed on different substrates dies, and the scope of the claimed subject matter is not limited in these respects.

Sound-detecting MEMS microphones are one of the few applications that have exploited the mechanically-active modes of suspended thin films. When it comes to producing sound, however, for both portable and sedentary applications, MEMS thin film electrostatic transducers have not been as favored as piezoceramics or the traditional magnetic and/or inductive voice coil elements. The latter choices pose significant disadvantages in both the quality of sound produced and the energy needed to produce it because of resistive losses in the voice coil and the larger mass of both the vibrating diaphragms and the moving coil. Yet, piezoceramic and voice coil technologies are ubiquitous because displacing volumes of air large enough to produce audible acoustic pressure changes requires significant mechanical displacement which is difficult to attain using micron-thick or thicker films of conventional IC material sets deflecting at reasonably low actuation voltages, for example lower than about 10 volts. We have demonstrated, however, that sub-200-nm-thick printed metallic nanomembranes of arbitrarily-large areas exhibit larger deflections at lower voltages in comparison to standard micron-thick or thicker silicon-based diaphragms, and these nanomembranes can overcome the aforementioned technical hurdles to implement energy-efficient, sound-production actuators with relatively low manufacturing complexity.

Referring now to FIG. 2 and FIG. 3, an elevation view and a top plan view of the electrostatic transducer of FIG. 1 in accordance with one or more embodiments will be discussed. FIG. 2 and FIG. 3 show that the cavities 114 in the dielectric layer 112 may have a radius r, the dielectric layer 112 itself may have a thickness of g as a distance of separation between the first electrode 116 and the counter electrode 110. It should be noted that the distance of separation between the first electrode and the counter electrode over the cavities 114 can change when any sort of actuation or force or pressure is applied or is incident on the transducer. Actuation may be applied in the form of an electrostatic signal, an electrical signal such as a voltage or a current, or an acoustic signal or pneumatic signal, and the scope of the claimed subject matter is not limited in these respects. The electrostatic transducer 100 may comprise an electrostatic acoustic transducer when operated as an actuator where an electrical signal or a combination of electrical signals (both DC signals and/or time-varying AC signals) is applied between its first and second electrodes which causes repetitive deflections of its membrane to generate acoustic waves or sound. In such an arrangement, the electrostatic acoustic transducer 100 may be referred to as a driver or a receiver or a speaker or a microspeaker or a loudspeaker, an audio driver, an audio receiver, or a motor, and the scope of the claimed subject matter is not limited in these respects. When the first electrode 116 comprising a membrane or the nanomembrane or the diaphragm of the electrostatic acoustic transducer 100 deflects repeatedly at a rate fast enough to match audio frequencies or deflects repeatedly such that it follows the input time-varying electrical signal applied to its first and second electrodes, the motion of the membrane produces sound. This sound also may be referred to as an acoustic wave, an acoustic signal, one or more acoustic pulses, a sound wave, an audio signal, a dynamic pressure wave, a pressure disturbance, and/or a pressure perturbation, and the scope of the claimed subject matter is not limited in these respects.

FIG. 4 and FIG. 5 are top plan views of alternative embodiments of the electrostatic transducer as shown in FIG. 3, except that in FIG. 4 the cavities have a generally square or rectangular shape from the top plan view, and in FIG. 5 the cavities have a generally elliptical shape from the top plan view. In these embodiments, the cavities may have a half-width or side length across the shorter span or the longer span analogous to a radius of a circle, and the scope of the claimed subject matter is not limited in this respect. For example, in FIG. 4, the cavities 114 may have a half-width of r, or a half-diagonal of s. In FIG. 5, the cavities 114 may have a half-width of r across the longer span, or a half-width of s across the shorter span. These values of r and/or s for shapes such as shown in FIG. 4 or in FIG. 5 may be utilized alone or in combination in a manner analogous to the radius r of a circle to determine the operating characteristics of the electrostatic transducer, for example as shown in and described with respect to Table 1, below, although the scope of the claimed subject matter is not limited in this respect.

We have demonstrated that our nanostructured metallic membranes exhibit near-ideal spring-like behavior in the human audio frequency range of about 20 Hz to 20 kHz and provide a flat acoustic frequency response which is devoid of any mass-related resonances or devoid of any resonances in general when coupled to small air volumes like those of the human ear. In such embodiments, the electrostatic transducer 100 may be referred to as an electrostatic audio transducer that is capable of functioning as an audio speaker or driver or receiver, or as an audio microphone. It should be noted that a speaker or a driver sometimes may be referred to as a receiver, for example in the context of hearing aids, and the scope of the claimed subject matter is not limited in this respect. It should be noted, however, that the metallic membrane also may be capable of operating in other frequency ranges in the human audio frequency range, in an infrasonic frequency range, or an ultrasonic frequency range, or combinations thereof, and the scope of the claimed subject matter is not limited in this respect. For example, when the electrostatic transducer 100 functions in an ultrasonic range, the electrostatic transducer 100 may be referred to as an electrostatic ultrasonic transducer. The ability to provide a flat frequency response in a desired frequency range may be used to implement high-fidelity and high power-efficiency acoustic emitters or drivers or speakers or microspeakers that consume minimal electric power due to their inherent capacitive nature for quality-critical applications such as hearing-aids, tactical communication headsets, and Bluetooth headsets, and other applications such as biometric earbuds, health-tracking earphones/earbuds, headphones, and earphones. The mechanical-acoustic coupling efficiency in acoustic-cavity-coupled regimes for frequencies below 20 kHz can be increased by varying parameters such as dielectric cavity radii, suspended membrane radii, membrane thickness, membrane area, membrane material and composition, and dielectric cavity depth. In an exemplary embodiment, audible sound can be produced while constraining the total device area to less than 100 square millimeters ($mm^2$) and actuation voltages to below 10 volts. Effective sound pressure level (SPL) values in the cavity-coupled regimes should exceed 80 dB SPL and approach over 100 dB SPL for hearing aid and tactical headset applications. Such SPL values may be achieved at various parameter ranges using an electrostatic transducer as shown for example in FIG. 1. Example SPL values are shown in Table 1, below. SPL values are specified on a decibel scale (dB SPL) with a reference pressure of 20 micro-Pascals corresponding to 0 dB SPL.

TABLE 1

SPL values for the electrostatic transducer operating as a microspeaker

| | | Space Layer Thickness, $g_0$ (microns) | | | |
|---|---|---|---|---|---|
| | | 0.4 | 1.0 | 1.5 | 3.0 |
| Cavity Radius, r (microns) | 12.5 | 80 dB SPL 16 V | 88 dB SPL 65 V | 91 dB SPL 120 V | 97 dB SPL 339 V |
| | 25 | 80 dB SPL 4 V | 88 dB SPL 16 V | 91 dB SPL 30 V | 97 dB SPL 85 V |
| | 50 | 80 dB SPL 1 V | 88 dB SPL 4 V | 91 dB SPL 7.5 V | 97 dB SPL 21 V |
| | 100 | 80 dB SPL 0.25 V | 88 dB SPL 1 V | 91 dB SPL 1.9 V | 97 dB SPL 5.3 V |

The voltage specified in each cell in Table 1 above is the pull-in voltage of the membrane, and it represents the peak-to-peak amplitude of the time-varying actuation voltage signal required to produce the sound pressure level in decibels specified in that cell. The sound pressure levels specified are those produced by the MEMS/NEMS acoustic emitter in a coupled air cavity of about two cubic centimeters ($cm^3$) volume. Cells with red text highlight parameter combinations for applications in portable sound sources or sound emitters such as hearing aids, earphones, headphones, in-ear drivers, in-ear ear buds, in-ear ear-canal earphones, hearables, wireless headsets using Bluetooth for example or earphones, radio communication equipment, and/or tactical headset acoustic emitters, although the scope of the claimed subject matter is not limited in this respect.

Referring now to FIG. 6, a diagram of an ear canal coupling structure in accordance with one or more embodiments will be discussed. As shown in FIG. 6, an ear canal coupling structure 600 may include a housing 610 to couple an electrostatic acoustic transducer 100 to an ear canal 618 of a user, also referred to as an external auditory meatus or an external acoustic meatus. In some embodiments, housing 610 may include an earbud structure 612 formed as part of the housing, and in other embodiments the earbud structure 612 may be a separate unit that is coupled with housing 610. The earbud structure 612 may have a tip 614 having a general shape, such as that of an earmold, for example, to fit into the ear canal 618 to seal or nearly seal the air volume of the ear canal 618 and to acoustically couple the electrostatic acoustic transducer 100 to the ear canal 618. The tip 614 may comprise, for example, silicone, gel, elastomer, or rubber to achieve a flush mating between the tip 614 and/or the earbud structure 612 and the earbud canal or external auditory meatus 618, and/or between the tip 614 and the housing 610 or an air tube, although the scope of the claimed subject matter is not limited in this respect.

In some embodiments, the tip 614 may directly couple with housing 610 in an air sealed manner, or in a nearly air sealed manner, without using earbud structure 612. In other embodiments, the tip 614 may couple to housing 610 which may comprise an air tube to acoustically couple to another device or housing or structure (not shown). In some embodiments, the ear canal coupling structure 600 may be disposed in an earmuff 616 which may cover or at least partially seal an auricle, or pinna, 620 of the user. In such embodiments, the ear canal coupling structure 600 may be disposed internal to the earmuff 616 to provide acoustic coupling and/or sealing of the air volume between electrostatic acoustic transducer 100 and the ear canal 618 or external auditory meatus. The ear canal coupling structure 600 of FIG. 6, and/or or any element thereof such as tip 614, may be utilized with the headphone device, hearing aid and/or personal sound amplification product (PSAP), or earbud as shown in and described with respect to FIG. 9, FIG. 10, and FIG. 11, below.

Referring now to FIG. 7, a graph of the frequency response of the electrostatic microspeaker of FIG. 1, FIG. 2, and FIG. 3 in accordance with one or more embodiments will be discussed. As shown in FIG. 7, the graph 700 shows four example plots of the frequency response of the electrostatic transducer 100 of FIG. 1, FIG. 2, and FIG. 3 functioning as a microspeaker or an electrostatic acoustic transducer, operated in a closed coupler cavity with a volume of about two cubic centimeters. Plot 710 was made with an offset or bias of 10 volts (V) direct current (DC) and applied signal of 2.1 volts root mean square (RMS). Plot 712 was made with an offset of 10 V DC and applied signal of 2.1 V RMS. Plot 714 was made with an offset of 12 V DC and an applied signal of 2.5 V RMS. Pot 716 was made with an offset of 12 V DC and an applied signal of 2.5 V RMS. The magnitude of the acoustic output of the electrostatic acoustic transducer 100 is shown on the vertical axis of dB (SPL/volt) versus a frequency range in Hertz (Hz) of 50 Hz to 20 kHz on the horizontal axis over the audible hearing range comprising lower and upper bass frequencies 718, midrange frequencies 720, and upper midrange and treble frequencies 722.

As can be seen in graph 700, the electrostatic acoustic transducer comprising the electrostatic transducer 100 may have flat frequency response with a slope of approximately 0 dB per decade in the region 724 that primarily comprises human speech from about 800 Hz to about 6 kHz or 7 kHz, although the scope of the claimed subject matter is not limited in this respect. Furthermore, the frequency response of the electrostatic microspeaker comprising the electrostatic transducer exhibits no resonance peaks from bass frequencies to about 20 kHz. In one or more embodiments, the frequency response as shown in FIG. 7 may be obtained when the electrostatic transducer 100 is coupled to an enclosed volume of about two cubic centimeters to result in a frequency response that is substantially uniform at frequencies of interest such as the spectral range of human hearing. In some embodiments, a uniform frequency response may mean that the ratio of generated acoustic sound pressure to an input electrical voltage is substantially uniform in a frequency range of about 10 Hertz (Hz) to about 20 kilohertz (kHz) when the electrostatic acoustic transducer is driven with an electrical signal in the frequency range and coupled to a volume of about two cubic centimeters or to a volume between about 0.1 cubic centimeters to about five cubic centimeters. In other words, the electrostatic acoustic transducer 100 does not add any or much spectral acoustic distortion or color to the output. As a result, the electrostatic acoustic transducer 100 may be suitable for several audio applications as shown for example in FIG. 8 through FIG. 11, below. Recent work has shown acoustic frequency response curves from multiple tests of additively-printed nanomembrane electrostatic microspeakers as shown in FIG. 7 herein. Note the flat and uniform frequency response from 1000 Hz to 20 kHz. Below 800 Hz, the response may have been corrupted by ambient noise. The electrostatic microspeaker output below 800 Hz in FIG. 7 is dominated by ambient noise present during the measurement, and, as a result, below 800 Hz, the frequency response curve shown is not characteristic of the electrostatic microspeaker's acoustic output since its acoustic output is being corrupted, stifled, muffled, or drowned out by the noise in the measurement room.

Referring now to FIG. 8, a block diagram of an example architecture for an electronic device that utilizes the electrostatic transducer 100 of FIG. 1, FIG. 2, and FIG. 3 in one or more embodiments will be discussed. Such an architecture 800 may be suitable for various audio applications and/or devices and may include more or fewer components than shown depending on the particular application or device in which the electrostatic acoustic transducer 100 is utilized. In one example, architecture 800 may include one or more microphones 810 to provide an input to a preamplifier 812 also referred to as a preamp. The output of the preamplifier 812 may be converted to digital signal via analog-to-digital converter (ADC) 814 which provides a digital signal to processor 816 which may include one or more processors and/or one or more digital signal processors (DSPs). The processor 816 may couple to a memory 818 to store data and/or code or instructions, and which may execute one or more operations on the one or more digital signals, for example digital filtering, mixing, or other digital signal processing operations.

Processor 816 may provide a digital output to digital-to-analog converter (DAC) 820 to provide an analog signal to amplifier 824 which may be applied to the electrostatic acoustic transducer 100 to produce audible sound. In some embodiments, amplifier 824 may be referred to as a power amplifier. In some embodiments, preamplifier 812 may provide an analog signal directly to an analog processing block 826 that optionally may be controlled by processor 816. Analog processing block 826 may provide filtering, amplification, attenuation, and so on, of the analog signal, before the analog signal is passed to amplifier 824, although the scope of the claimed subject matter is not limited in this respect. In some embodiments, architecture 800 may include a wireless interface and/or transceiver 822 such as a Bluetooth interface and/or transceiver, Wireless-Fidelity (Wi-Fi) interface and/or transceiver, a cellular interface and/or transceiver, and so on, to couple architecture 800 to one or more other devices, although the scope of the claimed subject matter is not limited in this respect. For devices that utilize wireless devices, one or more radio-frequency standards may include a Bluetooth standard, a Third Generation Partnership Project (3GPP) standard, a Wireless-Fidelity (Wi-Fi) standard, an Institute of Electrical and Electronics Engineers (IEEE) standard, a Zigbee standard, a Fifth Generation (5G) New Radio (NR) standard, an Ultra-wideband (UWB) standard, a near-field magnetic induction (NFMI) standard, a telecoil or audio-frequency induction loop standard such as, but not limited to, IEC 60118-4 or BS 7594, or a combination thereof, and the scope of the claimed subject matter is not limited in this respect. In some embodiments, the interface 822 alternatively may comprise a wired interface instead of a wireless interface, and in general may include various input/output (I/O) systems, interfaces, and/or transceivers such as Universal Serial Bus (USB) as one example, and the scope of the claimed subject matter is not limited in these respects. In some embodiments, audio processing system 800 may include a telecoil 828 to provide an input to ADC 814, although the scope of the claimed subject matter is not limited in this respect. Alternatively, the output of telecoil 828 may be provided directly to analog processing block. In some embodiments, a telecoil may also refer to an audio induction loop or system, audio-frequency induction loops (AFILs), or hearing loops. In addition, audio processing system 800 may include one or more batteries and/or various power circuits 830, and the scope of the claimed subject matter is not limited in this respect.

Audio processing system architecture 800 of FIG. 8 shows one particular arrangement and connection of the elements of an example audio processing system. In other embodiments, audio processing system architecture 800 may include more or fewer elements than shown, and/or various arrangements and connections of the elements, and the scope of the claimed subject matter is not limited in this respect. For example, processor 816 may couple to DAC 820 which then couples to wireless interface/transceiver 822 which in turn may directly drive electrostatic acoustic transducer 100 via a wired or wireless connection without requiring or involving amplifier 824. Alternatively, the DAC 820 may directly drive electrostatic acoustic transducer 100 without requiring or involving amplifier 824. In another arrangement, the analog processing block 826 may directly drive electrostatic acoustic transducer 100 without requiring or involving amplifier 824. In yet another arrangement, the analog processing block 826 may provide an output to wireless interface/transceiver 822 which in turn may directly drive electrostatic acoustic transducer 100 via a wired or wireless connection without requiring or involving amplifier 824. In some embodiments including these discussed embodiments, amplifier 824 optionally may be bypassed and the electrostatic acoustic transducer 100 driven by the output of another element, for example where electrostatic acoustic transducer 100 is capable of operating at lower voltages such as a voltage of about 10 volts peak-to-peak or less since electrostatic acoustic transducer 100 may not require high-currents to operate. The audio processing system architecture 800 may be deployed in various audio devices or applications in which electrostatic acoustic transducer 100 may be utilized as an audio transducer or speaker, for example as shown in and described with respect to FIG. 9, FIG. 10, or FIG. 11, below.

Referring now to FIG. 9, a diagram of an example headphone device that utilizes an electrostatic acoustic transducer 100 in accordance with one or more embodiments will be discussed. FIG. 9 shows an example headphone device 900 in which one or more electrostatic acoustic transducer 100 may be utilized in one or more headphone earmuffs 910. One or more of the earmuffs 910 may be supported on the user's ear or outer ear via a support structure 912 that may comprise for example a headband. The earmuffs 910 may be in communication with each other via an optional wired connection 914 and/or a wireless connection, either or both of which in some embodiments may be used to connect to a remote device such as a smartphone, computer, tablet, and so on, as one source for audio. The architecture 800 of FIG. 8 may be included, at least in part or in whole, in one or both of the earmuffs and/or in the headband or other apparatus supporting one or both of the earmuffs as an example deployment. In such embodiments, one or more of the earmuffs 910 or support structure 912 may include a wireless receiver, a wireless transmitter, a telecoil, or a transceiver to receive an electrical or an audio signal from a remote device, to communicate between the earmuffs 910, and/or to control at least a portion of the operation of the headphone device 900 including offloading at least a portion of the processing for the headphone device, although the scope of the claimed subject matter is not limited in this respect. In some embodiments, a power source such as a battery may be included in one or more of the earmuffs 910 and/or support structure 912.

Referring now to FIG. 10, a diagram of an example hearing aid or personal sound amplification product (PSAP) device that utilizes an electrostatic acoustic transducer 100 in accordance with one or more embodiments will be discussed. In one or more embodiments, a PSAP may include one or more of the following devices: hearing aids, hearables, smart earbuds, noise cancellation earbuds, wireless headsets, and so on, and the scope of the claimed subject matter is not limited in this respect. The hearing aid or PSAP device 1000 may include a housing 1012 or base in which one or more of electrostatic acoustic transducer 100 and/or the architecture 800 of FIG. 8 may be disposed, at least in part or in whole, and an earbud (or earmold) 1010. In some embodiments, the electrostatic acoustic transducer 100 may operate as a speaker or driver, and/or a microphone. It should be noted that a speaker or a driver sometimes may be referred to as a receiver, for example in the context of hearing aids, and the scope of the claimed subject matter is not limited in this respect. The electrostatic acoustic transducer 100 also may be disposed in the earbud 1010. In some embodiments, one or multiple electrostatic acoustic transducers 100 may be disposed in a single headphone, earmuff, earbud, PSAP housing 1012, and/or earbud, for example to increase the overall SPL output, and the scope of the claimed subject matter is not limited in this respect. In one embodiment, a connector 1014 may include wiring to couple the electrostatic acoustic transducer 100 to the architecture 800. Alternatively, the electrostatic acoustic transducer 100 may be disposed in the housing 1012, and the connector 1014 may comprise an acoustic coupling tube or tubing to couple the acoustic output or the sound generated by the electrostatic acoustic transducer 100 to the earbud 1010. In one or more alternative embodiments, the earbud 1010 (or earmold 1010) also may comprise an acoustic coupling device (that does not contain any microspeakers), it is inserted and/or placed into the ear canal, also referred to as an external auditory meatus or external acoustic meatus, and it forms a seal with the ear canal to acoustically isolate the ear canal from the outside environment. Acoustic isolation of the ear canal means that there is no path, or effectively no path or very little path, for the sound produced in the ear canal by the PSAP and/or microspeakers to escape to the atmosphere, ambient, or air outside the ear canal. Such acoustic isolation may be applied to various other types of acoustic devices such as sealed headphones, earbuds, and so on, and the scope of the claimed subject matter is not limited in this respect. In some embodiments, the headphone device of FIG. 9 may include an earbud type coupling device or structure in one or more earmuffs 910 to acoustically couple the electrostatic acoustic transducer 100 inside the earmuff 910 with an external acoustic meatus to provide an air sealing function at least in part, which may be provided in any device described herein. In some embodiments, housing 1012 and earbud 1010 may be formed as a single unit without connector 1014, and in other embodiments the connector 1014 may comprise an air tube or an electrical wire to couple the earbud 1010 with the housing by a selected distance. Hearing aid or PSAP device 1000 may include a power source such as a battery, for example in housing 1012 and/or in earbud 1010, optionally with a battery port to replace the battery. The battery may be chargeable and the hearing aid or PSAP device 1000 may include a charging port to charge the battery from a power source or an external battery pack, and/or the hearing aid or PSAP device 1000 may include a wireless or inductive charging system to charge the battery. It should be noted that these are merely example arrangement of the PSAP device 1000 of FIG. 10, and the scope of the claimed subject matter is not limited in these respects.

Referring now to FIG. 11, a diagram of one or more earbuds that utilize one or more electrostatic microspeakers 100 in accordance with one or more embodiments will be discussed. The earbuds 1100 of FIG. 11 may comprise an earbud portion 1110 and a body portion 1112. The body portion 1112 may house the architecture 800, and the earbud portion 1110 may house the electrostatic acoustic transducer 100. Alternatively, the earbuds 1100 may comprise only the earbud portion 1110 (without the body portion 1112), and the earbud portion may house one or more of the electrostatic acoustic transducer 100 and/or the architecture 800.

In addition to the electrostatic acoustic transducer 100 and/or the architecture 800, the hearing aid or PSAP device 1000, the headphone device 900, and the earbuds 1100 may house, in their various embodiments, one or more of the following: a power source such as a battery cell/s, batteries, and/or a rechargeable battery, an electrically conducting port that connects to the internal battery and allows it to be recharged, a wireless port that allows the battery to be recharged wirelessly, an inertial measurement unit comprising one or more of an accelerometer capable of sensing accelerations in one or two or all three orthogonal spatial dimensions (x, y, z), an angular rate sensor or gyroscope capable of sensing rotation angle and/or angular speed and/or angular velocity and/or rate of rotation about one or two or all three orthogonal rotation axes to detect yaw, pitch, or roll, one or more rate-integrating gyroscopes, one or more pressure sensors, one or more magnetometers, one or more microphones disposed variously in the housing to pick up sound from different or same directions and/or from inside the ear canal, one or more capacitive touch sensors, one or more optical sensors such as photodetectors, one or more light emitting diodes (LEDs)/organic LEDs/indicator lights/indicator screens, one or more ultrasound transmitters, one or more ultrasound receivers, one or more ultrasound transducers, one or more health biometrics sensors, one or more heart-rate monitors or sensors, one or more blood-flow monitors, and other sensors and actuators. Devices 900, 1000, and 1100 may also communicate (via wires or wirelessly) with, and send and receive signals and/or commands and/or content to and from, other devices such as 900, 1000, 1100, and/or cellphones/smartphones, computers, tablets, smart watches, wireless information relay systems such augmented reality audio/visual systems, loudspeakers, televisions, cinema displays, home entertainment systems, public announcement/broadcast systems, and inflight entertainment systems in airplanes. A pair of earbuds 1100 may be used to provide stereo operation, or one earbud 1100 may be used individually. The earbuds 1100 may be coupled via a wired connection or may be coupled by a wireless connection for example using the wireless interface 822 of architecture 800, although the scope of the claimed subject matter is not limited in this respect. A pair of headphone earmuffs 910 may be used to provide stereo operation. The earmuffs 910 may be coupled via a wired connection or may be coupled by a wireless connection for example using the wireless interface 822 of architecture 800, although the scope of the claimed subject matter is not limited in this respect. A pair of PSAPs or hearing aids 1000 may be used to provide stereo operation. The PSAPs or hearing aids 1000 may be coupled via a wired connection or may be coupled by a wireless connection for example using the wireless interface 822 of architecture 800, although the scope of the claimed subject matter is not limited in this respect.

Referring now to FIG. 12, a diagram of an example contact-transfer printing process to fabricate an electrostatic transducer to be utilized in an electrostatic microspeaker or an electrostatic microphone in accordance with one or more embodiments will be discussed. FIG. 12 shows our process flow for the additive contact-transfer printing of metal membranes on a variety of substrates including rigid substrates, and/or viscoelastic or flexible and transparent substrates. FIG. 12 shows the additive contact-transfer printing of metal membranes on conventional silicon and/or silicon dioxide substrates, as one exemplary material set for forming electrostatic transducers/microspeakers. Note that the mesa structures in the transfer pad substrate may refer to planarized surfaces that are raised above or that rise above the plane of the substrate.

Materials and associated processing for mechanically-active nanomembranes and underlying micro/nano structured substrates including nanomembrane materials and associated processing over large areas will now be discussed. We have demonstrated contact-transfer-liftoff printing of ~100-nm-thick metallic membranes. Our work has shown that these films exhibit repeatable deflections on the order of hundreds of nanometers at frequencies of up to at least low megahertz. An exemplary nanomembrane would be about 50 nanometers (nm) to about 150 nm thick and would have areas ranging from a few micrometers squared to about 100 square millimeters ($mm^2$) or even 1000 $mm^2$ and larger. Remarkably, these purely metallic films also exhibit consistent near-ideal spring-like behavior at human audio frequencies devoid of any mass-related mechanical resonances or other resonances that can be deleterious to device performance in many applications. These metallic nanomembranes are a superior alternative to conventional semiconductor, polymeric or piezoceramic thin films for a variety of MEMS/NEMS sensor and actuator applications, including acoustics and optics, and offer better performance in terms of energy efficiency, frequency response, and fabrication cost reduction.

Referring now to FIG. 13, a diagram of example transparent and flexible thin film materials for sensors and actuators in accordance with one or more embodiments will be discussed. FIG. 13 shows transparent and flexible thin film materials for large area scalable sensors and actuators. Capacitive MEMS fabricated on a flexible PET-PDMS substrate (~0.5-inch side length) with nanostructured metallic membranes are shown at (a). A scanning electron micrograph of silver nanowires embedded in a parylene membrane made via CVD and spray coating is shown at (b). These membranes are transparent at visible wavelengths, as shown in (c). The black arrows indicate the transparent membrane in (c). These transparent, electrically-conducting, and flexible membranes are exemplary candidates for deflectable thin films in exemplary applications such as transparent and/or flexible electrostatic microspeakers, transparent and/or flexible microphones, and other transparent and/or flexible sensor and actuator transducers.

Referring now to FIG. 14, a diagram of an array of nanomembranes on an arbitrary-area flexible substrate with patterned electrodes, patterned spacer layers, and electronics for addressing the nanomembranes in accordance with one or more embodiments will be discussed. Although FIG. 14 shows a flexible substrate, other types of substrates may be utilized such as a rigid substrate or a non-regular substrate, and the scope of the claimed subject matter is not limited in this respect. Patterned spacer layers may be utilized to form the cavities, gaps, or recesses of the electrostatic acoustic transducer of FIG. 1, although the scope of the claimed subject matter is not limited in this respect. FIG. 14 shows a two-dimensional (2D) array 1400 of nanomembranes 1410 on an arbitrary-area flexible substrate 1420 with patterned electrodes, patterned spacer layers, and appropriate electronics for addressing each membrane such as row selecting multiplexer 1416 and column selecting multiplexer 1418. This general device architecture may be used in myriad applications such as flexible and transparent speakers, listening windows, phased array directional speakers, directional microphones, noise-cancelling walls, textile-integrated acoustic transducers for wearables, sensor skins, pressure sensing arrays, luster changing displays, digital light processing arrays, and mechanically responsive haptic surfaces. Current IC-related fabrication platforms present significant technological barriers to achieving such device architectures. Each nanomembrane 1410 may comprise an electrostatic transducer device 100 comprising a MEMS or NEMS subsystem with a nanostructured membrane. Each nanomembrane device 1410 may be controlled via a control switch transistor 1412 and a resistor 1414 to provide a time constant ($\tau_{RC}$) value. The circuit shown may be a general example of a timing circuit, for example to detect changes in capacitance via changes in the time constant. Other types of circuits also may be utilized in similar sensor and/or actuator geometries such as active matrix OLED displays or touch screens as used in a smartphone or a tablet, and the scope of the claimed subject matter is not limited in these respects.

Other candidates for large area conductive membranes of nanoscale thicknesses may include single and multilayered 2D materials such as graphene and molybdenum disulphide and other transition metal dichalcogenides, and metalized-polymer composites of sub-micron thicknesses, such as gold-parylene composite films. Metalized films of micron-thick parylene have been demonstrated as potential candidates for MEMS/NEMS but were shown to have low yields below gap heights of 3 microns due to stiction of suspended membranes to the underlying recessed surfaces. This failure mode can be addressed using chemical treatments of underlying surfaces and recesses with chemically-orthogonal surfactants, such as silanes and thiols, to prevent membrane stiction and improve yields.

Additionally, vapor deposition can be combined with spray coating to manufacture sub-micron thick conductive-nanowire-embedded polymer composites that are transparent and electrically conductive and that can be transfer-printed, or roll-to-roll printed, onto a variety of substrates in a scalable manner. Moreover, these films can be applied to MEMS/NEMS devices by deploying them over conventional semiconductor substrates with or without recesses and gaps, or over transparent and flexible micro/nano-patterned polymeric substrates which are also formed using large-area scalable processes such as molding, imprinting, and embossing of transparent viscoelastic polymers, such as polydimethysiloxane (PDMS) on polyethylene terephthalate (PET), metal oxide-polymer composites such as IZO-parylene, polymethyl methacrylate (PMMA), polyvinyl chloride (PVC), and conductive plastics such as ITO-PET. This material set and associated processing provide a unique integrated platform for the fabrication of large area, flexible, light-weight, and transparent micro/nano sensor and actuator sheets with wide-ranging applications such as textured electronic displays and sensor skins, in addition to the acoustic applications targeted in this specification.

Conventional recess, gap, and via formation in IC-foundry-processed substrates relies on standard micromachining techniques such as subtractive sacrificial etching of oxides and multi-wafer bonding. These processes depend on multi-mask flows and on harsh chemical solvent treatments at elevated temperatures that degrade polymeric substrates and thin membranes.

For many large-area applications, it is crucial that alternative non-restrictive processes are utilized for micro/nano structuring of substrates consisting of an array of materials that includes glass, conductive plastics such as ITO-PET, viscoelastic polymers such as PDMS, thin film polymers, acrylics, cellulose, and textile fabrics. Besides room-temperature molding and sacrificial layer dissolution, techniques such as imprinting of thin polymeric substrates to form sub-micron gaps, cavities, and recesses in these substrates can also be employed. The nanomembranes discussed herein may then be integrated with these recess-patterned substrates to implement large area sensors and actuators such as artificial skins, acoustically-active listening windows, and vibrational-energy harvesting panes in addition to the acoustic applications targeted in this specification.

Micro and nanostructured recesses or cavities can be also imprinted in polymeric films such as those of PMMA and PEDOT via hot embossing. These recesses can serve as the capacitive dielectric gaps of an electrostatic MEMS/NEMS transducer such as electrostatic transducer 100 of FIG. 1, for example as shown in and described with respect to FIG. 15, below. These conductive thin-film and polymeric substrate formation and embossing techniques can serve as a cost-effective, area-scalable manufacturing process for MEMS/NEMS applications that involve mechanically-active sensing and actuation.

Referring now to FIG. 15, a diagram of large area substrate nanostructuring and additive membrane deployment techniques in accordance with one or more embodiments will be discussed. Imprinting thin layers such as acrylics with nanostructures to form cavities and gaps via hot embossing or imprinting is shown at (a). A schematic showing roll-to-roll additive deployment of a nanomembrane over a micro/nano structured substrate such as those fabricated in (a) is shown at (b).

As shown in FIG. 15, a silicon master pattern 1510 with pattern structures 1512 may be applied to PMMA 1516 on a glass or silicon substrate 1420. Heat and pressure may be applied to create the pattern 1514 in the PMMA 1516 to create micro-structured or nano-structured transducer substrates 1420. The nanomembranes 1410 may be rolled onto a substrate 1420.

Mechanically-active nanomembranes for audio acoustics and ultrasonic device applications may be manufactured to produce the electrostatic acoustic transducer as discussed herein. Acoustic sensors and actuators for both audio and ultrasonic frequencies are enabled by the aforementioned large-area, additive nano-structuring fabrication methods, including additive nanomembrane deployment over micro- and nano-structured recesses and gaps in underlying substrates to form variable capacitance electrostatic transducers. Below we outline some additional applications which can be enabled or greatly enhanced using the discussed micro-structuring and nano-structuring techniques.

Referring now to FIG. 16, an example architecture of an ultrasound system that utilizes a nanomembrane or an array of nanomembranes in an ultrasound transducer in accordance with one or more embodiments will be discussed. Ultrasonics for biomedical imaging, therapeutic applications, range finding, velocity sensing, gesture recognition, proximity sensing, fingerprint sensing, time-of-flight measurement/sensing, and occupancy detection may utilize the nanomembranes 1410 and/or the electrostatic transducer 100 as described herein. Micro-structuring and/or nano-structuring of the substrates and the nanomembranes allows controlled engineering of the fundamental and higher order mechanical resonance modes and bandwidths of these nanomembrane transducers into the low megahertz (MHz) frequencies and higher where the acoustic impedance mismatch between the vibrating or deflecting membrane and the fluid above, which may comprise a gas or a liquid, is minimal. This phenomenon can be used to implement energy-efficient, portable and wearable, thin form-factor ultrasound transmitters (emitters) and receivers for various applications. Exemplary applications include medical imaging and diagnostics, wrist bands or collars that detect vital signs by measuring and tracking acoustic impedance changes or reflected acoustic waves as blood volume velocity changes through the blood vessels, and mechanically-active bandages that can focus ultrasound to controllably deliver drugs such as insulin through the skin-blood barrier. An even better integrated device solution for such timed, needleless drug delivery applications would include micro-volume ampules that are pumped and valved by the deflection of the nanomembranes to push out controlled volumes of drugs through microfluidic wells and channels in the ampules. Low-power and/or low voltage operation is advantageous for these portable ultrasound applications.

State-of-the-art capacitive micromachined ultrasonic transducers (CMUTs) utilize standard IC material sets and fabrication processes. They are complex to fabricate with multiple photolithography mask steps and wafer-to-wafer bonding, and require high operation voltages, often in excess of 150 volts. Piezoelectric micromachined ultrasonic transducers (PMUTs) require lower voltages than CMUTs, but are complex to fabricate in arrayed geometries and to integrate with driving and sense electronics, in addition to exhibiting inferior bandwidth. Our aforementioned MEMS/NEMS structures comprising suspended metallic or polymer-metal composite membranes could be used as low-voltage and/or low-power CMUTs for various applications including, but not limited to, medical diagnostics, subcutaneous imaging of blood vessels and biological tissue, and for therapeutic ultrasonics.

One example of an ultrasound device 1600 wherein the ultrasound transducer 1610 may comprise an array 1400 of nanomembranes 1410 as the individual transducers. A transmission (Tx) control circuit 1610 couples with a transmission/reception (Tx/Rx) interface 1612. The resulting signals from the nanomembranes 1410 may be converted to a digital signal via ADC 1614. The digital signal is provided to a beamforming circuit 1616 to provide a signal to signal processing circuit 1618 which provides an image to be displayed on display 1620. It should be noted that ultrasound system device 1600 illustrates one example arrangement of the elements of the device, and in one or more embodiments may include more or fewer elements, in various other orders, and the scope of the claimed subject matter is not limited in this respect.

In one or more embodiments, an ultrasonic probe may comprise a housing, and an array of electrostatic ultrasonic transducers disposed within the housing, wherein the electrostatic ultrasonic transducers comprise a substrate comprising a first material to function as a first electrode, a dielectric layer coupled with the first material, wherein the dielectric layer has one or more cavities formed therein, and a membrane coupled with the dielectric layer to cover the one or more cavities and to function as a second electrode, wherein the electrostatic ultrasonic transducer generates an ultrasonic wave in response to a signal applied to the first electrode and the second electrode, or generates an electrical signal across the first electrode and the second electrode in response to an reflection from a target of the ultrasonic wave impinging on the metallic membrane, wherein the applied signal comprises a direct-current (dc) bias or a time varying electrical signal, or a combination thereof. The array may comprise a one-dimensional array of M number of the electrostatic ultrasonic transducers, or a two-dimensional array of M number by N number of the electrostatic ultrasonic transducers. The array of ultrasonic transducer may comprise an arbitrary shape or configuration. The ultrasonic probe further may comprise circuitry to control the signal applied to electrostatic ultrasonic transducers in the array to generate an ultrasonic field. The ultrasonic probe of claim further may comprise circuitry to process the electrical signal generated by the electrostatic ultrasonic transducers in the array to allow an image of the target to be generated. The dielectric layer may have a density of the cavities of about 20 to about 100 per square millimeter. The substrate may comprise doped silicon, highly doped silicon, electrically-conducting silicon, indium tin oxide coated polyethylene terephthalate (ITO-PET), indium tin oxide coated glass (silicon dioxide), metal coated glass, or metal coated silicon, metal-coated polysilicon, or metal-coated silicon nitride. The dielectric layer may comprise silicon dioxide, intrinsic silicon, polysilicon, silicon nitride, aluminum oxide, a polymer, polydimethylsiloxane (PDMS), or a combination thereof. The membrane may comprise gold, silver, aluminum, chrome, copper, nickel, a single-layer graphene, a multi-layer graphene, or a combination thereof, or a metal and polymer composite, or parylene-gold. At least one or more of the one or more cavities may have a sloping sidewall. At least one or more of the one or more cavities may be connected to each other through breaks in their shared walls. The ultrasonic probe further may comprise an insulator layer covering at least a portion of a sidewall or a bottom of at least one or more of the one or more cavities, wherein the insulator comprises silicon dioxide, intrinsic silicon, polysilicon, silicon nitride, aluminum oxide, insulating polymers, polydimethylsiloxane (PDMS), or a combination thereof. The device may be excited repeatedly to produce pulses of ultrasonic vibration for sensing and imaging in various media such as air, water, saline, blood plasma, or biological tissue, or a combination thereof. The ultrasonic probe further may comprise an ultrasound transmitter and receiver system for imaging, sensing location, or therapeutic drug delivery or monitoring, or a combination thereof. The ultrasonic probe further may comprise a power source and control and signal processing circuitry to form a stand-alone imaging device, drug delivery device, or tissue monitoring device.

The following are example implementations of the subject matter described herein. It should be noted that any of the examples and the variations thereof described herein may be used in any permutation or combination of any other one or more examples or variations, although the scope of the claimed subject matter is not limited in these respects An electrostatic acoustic transducer may comprise a substrate comprising a first material to function as a first electrode, a dielectric layer coupled with the first material, wherein the dielectric layer has one or more cavities formed therein, and a membrane coupled with the dielectric layer to cover one or more of the one or more cavities and to function as a second electrode, wherein the electrostatic acoustic transducer generates an acoustic wave in response to an electrical signal applied between the first electrode and the second electrode, wherein the applied electrical signal comprises a direct-current (dc) bias voltage and one or more time-varying electrical signals. The cavities may be generally cylindrical having a radius and depth selected such that the generated acoustic wave has a sound pressure level (SPL) of about 0 decibels (dB SPL) to about 90 dB SPL or about 115 dB SPL or greater when the applied signal is about 10 volts peak-to-peak or less. The electrostatic acoustic transducer may be coupled to an enclosed volume of about two cubic centimeters or to an enclosed volume between about 0.1 cubic centimeters to about five cubic centimeters. The dielectric layer may have a density of the cavities of about 1 to about 100 cavities per square millimeter. The substrate may comprise doped silicon, highly doped silicon, electrically-conducting silicon, indium tin oxide coated polyethylene terephthalate (ITO-PET), indium tin oxide coated glass (silicon dioxide), metal coated glass, metal coated silicon, metal-coated polysilicon, or metal-coated silicon nitride. The dielectric layer may comprise silicon dioxide, intrinsic silicon, polysilicon, silicon nitride, aluminum oxide, a polymer, polydimethylsiloxane (PDMS), or a combination thereof. The membrane may comprise gold, silver, aluminum, chrome, copper, nickel, single-layer graphene, multi-layer graphene, or a combination thereof, or a metal and polymer composite, or parylene-gold. At least one or more of the one or more cavities may have a sloping sidewall. At least one or more of the one or more cavities may be connected to each other via one or more shared walls between one or more adjacent cavities. The one or more cavities may have varying sizes, radii, or depths, or a combination thereof, in the dielectric layer, or across two or more of the dielectric layers on a same substrate die or across two or more substrate dies. The electrostatic acoustic transducer further may comprise an insulator layer covering at least a portion of a sidewall, a bottom of at least one or more of the one or more cavities, or on top of the dielectric layer contacting the membrane, or a combination thereof. The ratio of generated acoustic sound pressure to an input electrical voltage may be substantially uniform in a frequency range of about 10 Hertz (Hz) to about 20 kilohertz (kHz) when the electrostatic acoustic transducer is driven with an electrical signal in the frequency range and coupled to a volume of about two cubic centimeters or to a volume between about 0.1 cubic centimeters to about five cubic centimeters. The electrostatic acoustic transducer further may comprise an additional membrane to cover one or more of the one or more cavities, wherein the membrane and the additional membrane have different thicknesses. The substrate may comprise a CMOS substrate die having one or more digital signal processing circuitry, analog signal processing circuitry, sense circuitry, drive circuitry, or power circuitry, or a combination thereof, fabricated on the CMOS substrate die. The dielectric layer may be disposed on two sides of the CMOS substrate die or on two or more of the CMOS substrate dies, and one or more membranes are coupled with dielectric layers on both sides to cover one or more of the one or more cavities and to function as the second electrode or a third electrode. The electrostatic acoustic transducer may generate an electrical signal across the first electrode and the second electrode in response to an acoustic wave impinging on the membrane. The electrostatic acoustic transducer may be capable of operating when the applied electrical signal is about 10 volts peak-to-peak or less. The electrostatic acoustic transducer further may comprise two or more membranes that are capable of being addressed independently or simultaneously. The electrostatic acoustic transducer further may comprise a meter or other sensor to detect a change in capacitance or a deflection of the membrane in response to an acoustic wave impinging on the membrane.

A method to fabricate a microelectromechanical system (MEMS) device via a contact-transfer printing process may comprise forming a MEMS stamp substrate, wherein the MEMS stamp substrate has one or more cavities formed therein, forming one or more mesa structures on a transfer pad substrate, depositing one or more blocking layers on the one or more mesa structures of the transfer pad substrate, depositing a release layer on the one or more blocking layers and depositing a diaphragm layer on the release layer to form one or more diaphragms on the one or more mesa structures, contacting the MEMS stamp substrate against the one or more mesa structures of the transfer pad substrate, and removing the MEMS stamp substrate to leave the one or more diaphragms covering at least one or more of the one or more cavities. The method further may comprise treating the release layer with a first material to separate the one or more diaphragms from the one or more mesa structures. The method further may comprise treating the release layer with a first material to substantially degrade or dissolve the release layer prior to or after contacting the MEMS stamp substrate against the one or more mesa structures. The first material may comprise a solvent or a solvent vapor. Dissolution of the release layer may occur in less than about 30 minutes to less than about 60 minutes. The MEMS stamp substrate may comprise an insulator material, a semiconductor material, a conductive material, two conductive materials separated by an insulator material, or by a semiconductor material, or by a dielectric material, or a combination thereof. The conductive material may comprise a metal or indium tin oxide or indium zinc oxide or highly doped silicon, and the semiconductor material comprises silicon, polysilicon, silicon nitride, an organic material or a combination thereof, and the insulator material comprises silicon dioxide, glass, polymers, polydimethylsiloxane (PDMS), aluminum oxide, high-k dielectrics, or a combination thereof. The diaphragm layer may comprise a metal or a composite of two or more materials. The method further may comprise heating the MEMS stamp substrate after said removing, wherein said heating is performed at a temperature of up to about 250 degrees Celsius for up to about 10 minutes, up to about 30 minutes, or up to about two hours or longer. The method further may comprise treating the MEMS stamp substrate with one or more solvents after said removing. The diaphragms may be processed separately from the underlying MEMS stamp substrate before the diaphragms are suspended over the one or more cavities in the MEMS stamp substrate during said contacting in a single contact-transfer printing operation.

A headphone device may comprise at least one ear muff comprising a structure to hold the at least one ear muff against an ear of a user, and at least one driver disposed in the at least one ear muff, wherein the at least one driver comprises an electrostatic acoustic transducer comprises a substrate comprising a first material to function as a first electrode, a dielectric layer coupled with the first material, wherein the dielectric layer has one or more cavities formed therein, and a membrane coupled with the dielectric layer to cover the one or more cavities and to function as a second electrode, wherein the electrostatic acoustic transducer generates an acoustic wave in response to an electrical signal applied between the first electrode and the second electrode, wherein the applied electrical signal comprises a direct-current (dc) bias voltage and one or more time-varying electrical signals. The cavities may be generally cylindrical having a radius and depth selected such that the generated acoustic wave has a sound pressure level (SPL) of about 0 decibels (dB SPL) to about 90 dB SPL or about 115 dB SPL or greater when the applied signal is about 10 volts peak-to-peak or less. The electrostatic acoustic transducer may be coupled to an enclosed volume of about two cubic centimeters or to an enclosed volume between about 0.1 cubic centimeters to about five cubic centimeters. The headphone device further may comprise at least one microphone and a processor disposed in the at least one ear muff to apply noise cancellation to the signal applied between the first electrode and the second electrode. The at least one microphone may comprise one or more additional electrostatic acoustic transducers configured to detect an acoustic wave impinging on the at least one microphone. At least a portion of the electrostatic acoustic transducer may be configured to function as a microphone. The electrostatic acoustic transducer may be configured to switch between a speaker function and a microphone function via time-division multiplexing. The headphone device further may comprise an additional ear muff and at least one additional driver in the additional ear muff, wherein the at least one additional driver comprises an additional electrostatic acoustic transducer, and the at least one ear muff and the additional ear muff are connected via a wired connection or via a wireless connection. The headphone device further may comprise a wireless receiver, a wireless transmitter, or a wireless transceiver to receive or transmit signals via a wireless protocol wherein the wireless receiver, wireless transmitter, or wireless transceiver are in compliance with a wireless communication standard or protocol. The headphone device further may comprise a battery and a recharging port to allow the battery to be recharged from a wired power source or a battery pack, or a wireless charging system to allow the battery to be recharged from a wireless power source, or a combination thereof. The headphone device further may comprise one or more sensors or one or more indicators, or a combination thereof. The ear muff may include an ear canal coupling structure to couple the acoustic wave generated by the electrostatic acoustic transducer to an external acoustic meatus or ear canal of a user. The ear canal coupling structure may comprise a compliant gasket to achieve a flush mating between the ear canal coupling structure and the external acoustic meatus or ear canal of a user or an air tube. The compliant gasket may comprise silicone, gel, an elastomer, a viscoelastic polymer, acrylic, vinyl, rubber, polyethylene, polymethyl methacrylate, polyurethane, viscoelastic urethane polymer, or SORBOTHANE, or a combination thereof. The headphone device further may comprise one or more processors disposed in the at least one ear muff or in at least one or more additional ear muffs, or a combination thereof, to couple with at least one or more processors disposed in a remote device such as a computer, a cellular phone, a smart phone, a smart watch, a tablet, or an electronic book reader, or a combination thereof, to control the headphone device or to control one or more functions of the remote device, via a wired connection or a wireless connection, or a combination thereof.

An earbud may comprise an earbud housing having a protrusion to fit into an external acoustic meatus or ear canal of a user, and a driver disposed in the earbud housing, wherein the driver comprises an electrostatic acoustic transducer comprising a substrate comprising a first material to function as a first electrode, a dielectric layer coupled with the first material, wherein the dielectric layer has one or more cavities formed therein, and a membrane coupled with the dielectric layer to cover the one or more cavities and to function as a second electrode, wherein the electrostatic acoustic transducer generates an acoustic wave in response to an electrical signal applied between the first electrode and the second electrode, wherein the applied electrical signal comprises a direct-current (dc) bias voltage and one or more time-varying electrical signals. The cavities may be generally cylindrical having a radius and depth selected such that the generated acoustic wave has a sound pressure level (SPL) of about 0 decibels (dB SPL) to about 90 dB SPL or about 115 dB SPL or greater when the applied signal is about 10 volts peak-to-peak or less. The electrostatic acoustic transducer may be coupled to an enclosed volume of about two cubic centimeters or to an enclosed volume between about 0.1 cubic centimeters to about five cubic centimeters. The earbud further may comprise a compliant gasket or tip to achieve a flush mating between the protrusion and the external acoustic meatus or ear canal of a user or an air tube. The compliant gasket may comprise silicone, gel, an elastomer, a viscoelastic polymer, acrylic, vinyl, rubber, polyethylene, polymethyl methacrylate, polyurethane, viscoelastic urethane polymer, SORBOTHANE, or a combination thereof. The compliant gasket may have no leakage or substantially not leakage from an enclosed air volume to an ambient environment. The earbud further may comprise at least one microphone and a processor disposed in the earbud housing to apply noise cancellation to the signal applied between the first electrode and the second electrode. The at least one microphone may comprise one or more additional electrostatic acoustic transducers configured to detect an acoustic wave impinging on the at least one microphone. At least a portion of the electrostatic acoustic transducer may be configured to function as a microphone. The electrostatic acoustic transducer may be configured to switch between a speaker function and a microphone function via time-division multiplexing. The earbud further may comprise an additional earbud comprising an additional earbud housing and at least one additional driver in the additional earbud housing, wherein the at least one additional driver comprises an additional electrostatic acoustic transducer, and wherein the earbud housing and the additional earbud housing are connected via a wired connection or via a wireless connection. The earbud further may comprise a wireless receiver, a wireless transmitter, or a wireless transceiver to receive or transmit signals via a wireless protocol, wherein the wireless receiver, wireless transmitter, or wireless transceiver are in compliance with a wireless communication standard or protocol. The earbud further may comprise a battery and a recharging port to allow the battery to be recharged from a wired power source or battery pack, or a wireless charging system to allow the battery to be recharged from a wireless power source, or a combination thereof. The earbud further may comprise one or more sensors or one or more indicators, or a combination thereof. The earbud further may comprise one or more processors disposed in the at least one earbud housing or in at least one or more additional earbud housings, or a combination thereof, to couple with at least one or more processors disposed in a remote device such as a computer, a cellular phone, a smart phone, a smart watch, a tablet, or an electronic book reader, or a combination thereof, to control the earbud or to control one or more functions of the remote device, via a wired connection or a wireless connection, or a combination thereof.

A hearing aid may comprise a housing and an audio processing system disposed in the housing, the audio processing system comprising at least one amplifier, an earbud formed as part of the housing or coupled to the housing to fit into an external acoustic meatus or ear canal of a user, one or more microphones coupled to an input of the amplifier, and one or more drivers coupled to an output of the amplifier to reproduce an amplified version of an input acoustic wave impinging on the one or more microphones, the audio processing system including a processor coupled between the microphone and the driver, wherein the processor is to provide one or more hearing correction functions, wherein at least one of the one or more drivers or the one or more microphones, or a combination thereof, comprises an electrostatic acoustic transducer, comprising a substrate comprising a first material to function as a first electrode, a dielectric layer coupled with the first material, wherein the dielectric layer has one or more cavities formed therein, and a membrane coupled with the dielectric layer to cover the one or more cavities and to function as a second electrode, wherein the electrostatic acoustic transducer generates an output acoustic wave in response to an electrical signal applied between the first electrode and the second electrode, wherein the applied electrical signal comprises a direct-current (dc) bias voltage and one or more time-varying electrical signals. The electrostatic acoustic transducer may generate an electrical signal across the first electrode and the second electrode in response to an input acoustic wave impinging on the membrane. The cavities may be generally cylindrical having a radius and depth selected such that the generated acoustic wave has a sound pressure level (SPL) of about 0 decibels (dB SPL) to about 90 dB SPL or to about 115 dB SPL or greater when the applied signal is about 10 volts peak-to-peak or less. The electrostatic acoustic transducer may be coupled to an enclosed volume of about two cubic centimeters or to an enclosed volume between about 0.1 cubic centimeters to about five cubic centimeters. The hearing aid further may comprise a compliant gasket, or earmold, or tip to achieve a flush mating between the earbud and the external acoustic meatus or ear canal of a user or an air tube. The compliant gasket, or the earmold, or tip may comprise silicone, gel, an elastomer, a viscoelastic polymer, acrylic, vinyl, rubber, polyethylene, polymethyl methacrylate, polyurethane, viscoelastic urethane polymer, SORBOTHANE, or a combination thereof. The driver may be disposed in the housing and acoustically coupled to the earbud. The compliant gasket may have no leakage or substantially no leakage from an enclosed air volume to an ambient environment. The at least one microphone may comprise one or more additional electrostatic acoustic transducers configured to detect an acoustic wave. The hearing aid further may comprise an additional housing and at least one additional driver in the additional housing, wherein the at least one additional driver comprises an additional electrostatic acoustic transducer, and wherein the housing and the additional housing are connected via a wired connection or via a wireless connection. The hearing aid further may comprise a wireless receiver, a wireless transmitter, or a wireless transceiver to receive or transmit signals via a wireless protocol, wherein the wireless receiver, wireless transmitter, or wireless transceiver are in compliance with a wireless communication standard or protocol. The hearing aid further may comprise a battery and a port to access and replace the battery, or a recharging port to allow the battery to be recharged from a wired power source or a battery pack, or a wireless charging system to allow the battery to be recharged from a wireless power source, or a combination thereof. The hearing aid further may comprise an analog-to-digital converter (ADC) between the at least one or more microphones and the processor, and a digital-to-analog converter (DAC) between the processor and the at least one or more drivers. The hearing aid further may comprise one or more sensors or one or more indicators, or one or more control switches, or a combination thereof. The audio processing system may be configured to provide selective attenuation, amplification, cancellation, reduction, or mixing, or a combination thereof, of ambient audio signals from the acoustic wave impinging on the at least one or more microphones based at least in part on processing of generated electrical signals from the at least one or more microphones. The audio processing system may be configured to provide directional selectivity, amplification, or attenuation, or mixing, or a combination thereof, of the acoustic waveform based at least in part on processing data, or information, or signals from one or more single-axis or multiple-axes gyroscopes, accelerometers, or microphones, or a combination thereof. The hearing aid further may comprise a telecoil to provide an input signal to an analog-to-digital converter (ADC) or to an analog processing block.

A personal sound amplification product (PSAP) may comprise a housing and an amplifier disposed in the housing, an earbud formed as part of the housing or coupled to the housing to be inserted into an ear canal of a user, one or more microphones coupled to an input of the amplifier, and one or more drivers coupled to an output of the amplifier to reproduce an amplified version of an acoustic wave impinging on the microphone, wherein at least one of the one or more microphones or the one or more drivers, or a combination thereof, comprises an electrostatic acoustic transducer, comprises a substrate comprising a first material to function as a first electrode, a dielectric layer coupled with the first material, wherein the dielectric layer has one or more cavities formed therein, and a membrane coupled with the dielectric layer to cover the one or more cavities and to function as a second electrode, wherein the electrostatic acoustic transducer generates an acoustic wave in response to an electrical signal applied between the first electrode and the second electrode, wherein the applied electrical signal comprises a direct-current (dc) bias voltage and one or more time-varying electrical signals.

An audio processing system may comprise one or more processors and one or more memory devices coupled to the one or more processors, at least one or more microphones to receive an input audio waveform and to generate an electrical signal in response to the input audio waveform, an analog-to-digital converter (ADC) to convert the electrical signal into a digital signal, wherein the digital signal is provided to the processor, a digital-to-analog converter (DAC) to convert a digital signal from the processor to an analog signal, and at least one or more drivers to convert the analog signal from the DAC to an output audio waveform, wherein at least one of the microphone or the driver, or a combination thereof, comprises an electrostatic acoustic transducer, comprising a substrate comprising a first material to function as a first electrode, a dielectric layer coupled with the first material, wherein the dielectric layer has one or more cavities formed therein, and a membrane coupled with the dielectric layer to cover the one or more cavities and to function as a second electrode, wherein the electrostatic acoustic transducer generates an acoustic wave in response to an electrical signal applied between the first electrode and the second electrode, wherein the applied electrical signal comprises a direct-current (dc) bias voltage and one or more time-varying electrical signals. The electrostatic acoustic transducer may generate an electrical signal across the first electrode and the second electrode in response to the input audio waveform or to an acoustic wave impinging on the membrane. The audio processing system further may comprise a preamplifier disposed between the at least one or more microphones and the ADC to amplify the generated electrical signal provided to the ADC. The audio processing system further may comprise one or more power amplifiers disposed between the DAC and the at least one or more drivers to amplify the analog signal driving the at least one or more drivers. The audio processing system further may comprise an analog processing block disposed between the preamplifier and the power amplifier to provide analog processing of the generated electrical signal, wherein the analog processing block comprises filter banks to selectively amplify or attenuate different frequency ranges in the electrical signal, and wherein the analog processing block is configured to filter, amplify, attenuate, mix, or delay, or a combination thereof, the generated electrical signal. The one or more processors may be configured to filter, amplify, attenuate, mix, delay, or distort, or a combination thereof, the one or more digital signals. The audio processing system further may comprise a wireless receiver, a wireless transmitter, or a wireless transceiver to transmit or receive wireless signals from or to the processor. The wireless receiver, the wireless transmitter, or the wireless transceiver may be in compliance with a wireless communication standard or protocol. The one or more processors may be configured to provide selective attenuation, amplification, cancellation, reduction, or mixing, or a combination thereof, of ambient audio signals from the input audio waveform based at least in part on processing of the generated electrical signals from the one or more microphones and the analog signal or the digital signal, or a combination thereof. The one or more processors may be configured to provide directional selectivity, amplification, or attenuation, or a combination thereof, of an input audio waveform based at least in part on processing data, or information, or signals from one or more single-axis or multiple-axes gyroscopes, accelerometers, or microphones, or a combination thereof. The audio processing system further may comprise an additional driver to receive an additional signal from the DAC to provide stereo sound or dual channel sound from the driver and the additional driver. The electrical signal may be applied between the first electrode and the second electrode comprises a discrete-time digital signal generated from a memory unit or a discrete-time digital signal from the ADC or a discrete-time digital signal from the one or more processors, without using the digital-to-analog converter (DAC).

In one or more embodiments, the substrate may be a rigid or a flexible substrate. The array further may comprise one of a column selecting multiplexer or a row selecting multiplexer. The array further may comprise a second electrode pair addressable by the power source independently of the first electrode pair. The metallic membrane may have a thickness gradient. The plurality of cavities may have one or more of different shapes, sizes or depths (see Table 1 for examples of values). The thickness gradient may be at least one of continuous or stepwise. The gradient may change in one or both a Cartesian geometry or in a cylindrical/polar geometry. The gradient may change such that the membrane is thickest at one end and thinnest at another. The membrane may have one of a uniform or a non-uniform thickness. The membrane thickness may change discretely across the membrane.

An array of addressable membranes may comprise a plurality of membranes arranged over a substrate, a first of the plurality of membranes forming a first diaphragm over a first cavity formed in the substrate, a first electrode integrated with the first cavity and communicating with the first diaphragm, the first electrode and the first diaphragm forming a first electrode pair, and a power source for biasing the first electrode pair, wherein the diaphragm deflects responsive to an applied bias from the power source. The diaphragm may deflect responsive to an external mechanical, acoustic, pneumatic or gas pressure signal. The array further may comprise a meter in communication with a plurality of electrode pairs for detecting a capacitance change between the first electrode and the first diaphragm responsive to an external signal. The array further may comprise a controller in communication with the meter, the controller having a processor circuit in communication with a memory circuit, the controller receiving a signal from the meter and identifying a change in capacitance corresponding to the received signal. The first electrode pair may communicate a change in potential between the first electrode and the diaphragm when the diaphragm is deflected or a change in current when the diaphragm is deflecting. The signal may vary in frequency from DC (0 Hertz) to 10 MHz for ultrasound applications. The signal may be a representation of speech, music, and audible acoustics. The devices and accompanying electronics and power source may be integrated into a single assembly (or housing) that is mechanically-coupled to an enclosed air volume, such as that of the ear canal (or the external acoustic meatus or the external auditory meatus). The membrane and/or the diaphragm may not be perforated. Perforations include etch holes and vias used in conventional subtractive fabrication processes to remove substrate material from under the diaphragm material to suspend the diaphragm. Such non-perforated membranes can only be suspended via an additive membrane/diaphragm fabrication process such as ours where the cavity/recesses in the underlying substrate are etched out prior to membrane suspension over them. The membrane and/or the diaphragm may be intentionally perforated before the transfer printing step, or after the transfer printing step, with perforations of varying sizes and geometries to achieve the desired electro-mechanical and mechano-acoustic response. The membrane and/or the diaphragm may be mechanically compliant and suspended without using discrete tethers, discrete suspension arms (crab-leg, H-type, U-beam, serpentine, hairpin suspensions), discrete springs, or discrete anchors. The signal applied to the device membrane and counter electrode to generate sound may be a continuous signal in time (analog signal). This signal can be generated from a digital signal using a digital-to-analog converter chip/processing unit.

Any one or more of the devices herein may be combined with inertial sensors such as MEMS gyroscopes and accelerometers on the same die or on a separate die in the same housing/assembly, to sense the orientation (angle and linear position) and the change in orientation of the device and to relay this information to the digital and analog signal processing blocks, where this orientation and change in orientation information is used to further process the sound signal before sending it to any device or a multitude of any device to generate sound. This signal processing done using orientation information relayed by the inertial sensors prior to driving any device can be used to (a) boost certain frequencies and reduce others frequencies, (b) boost the input signal from some microphones while reducing the signal from other microphones (other devices), thus amplifying the sound from certain directions while reducing it from other directions, (c) filter noise, (d) compute the directivity pattern of the sound that needs to be generated by arrays of any device membranes and the drive signal needed to achieve the directivity pattern for each device array. Each electrode pair may define a pixel. Multiple pixels in the array may be addressed independently and simultaneously to implement a digital speaker system using the scheme in claim 47 where the number of pixels that are deflecting ("ON" state) at a particular time is proportional to the amplitude of the electrical signal (which represents the sound we are trying to generate) at that time. Therefore, if the amplitude is higher, a greater number of pixels need to be in the "ON" state to produce the larger volume of sound required.

In an electrostatic transducer coupled to an enclosed volume, the enclosed volume may not exceed about 100 cubic centimeters, or wherein the enclosed volume is such that frequency dependence of compliance of the enclosed volume counters frequency dependence of compliance of the membrane to result in substantially uniform sound pressure level generated by the electrostatic acoustic transducer independent of drive frequency across frequencies from about 10 Hertz (Hz) to 20 kHz for a constant drive signal amplitude. The enclosed volume may have one or more vents or one or more acoustic paths to one or more larger acoustic volumes or one or more acoustic chambers of different volumes. The cavities may be formed in an array of M number of rows and N number of columns or in a hexagonally close packed array. The insulator between the membrane and the dielectric layer or substrate may comprise silicon dioxide, intrinsic silicon, polysilicon, silicon nitride, aluminum oxide, polymers, insulating polymers, polydimethylsiloxane (PDMS), polyvinyl acetate, acrylate-based polymers, polychloroprene, epoxy, cyanoacrylates, methyl 2-cyanoacrylate, ethyl-2-cyanoacrylate, n-butyl cyanoacrylate, 2-octyl cyanoacrylate, acrylic polymers, polyurethanes, polyols, polyesters, polyimide, glue, or a combination thereof. The acoustic wave pressure amplitude generated by an electrostatic acoustic transducer may be substantially uniform in a frequency range of about 10 Hertz (Hz) to about 12 kilohertz (kHz) when the electrostatic acoustic transducer is driven with a uniform electric signal in the frequency range and coupled to a volume of about two cubic centimeters or a volume between about 0.1 cubic centimeters to about five cubic centimeters.

In a process to form an electrostatic transducer, a solvent or solvent vapor may include acetone or chloroform or isopropyl alcohol or other organic solvents or combinations thereof. The release layer may be treated with a first material to substantially break the chemical bonds between the release layer and the one or more diaphragms. The release layer may be treated with a first material to reduce intermolecular forces between the release layer and the one or more diaphragms. The release layer may be substantially degraded or dissolved, which also may include or involve breaking the chemical bonds between the release layer and the one or more diaphragms and/or reducing the intermolecular forces between the release layer and the one or more diaphragms. The diaphragm may comprise a composite of a conductive material and a non-conductive material. The MEMS stamp substrate may be treated with one or more solvents comprising acetone, chloroform, isopropyl alcohol, or an organic solve, or a combination thereof.

For devices that utilize wireless devices, one or more radio-frequency standards may include a Bluetooth standard, a Third Generation Partnership Project (3GPP) standard, a Wireless-Fidelity (Wi-Fi) standard, an Institute of Electrical and Electronics Engineers (IEEE) standard, a Zigbee standard, a Fifth Generation (5G) New Radio (NR) standard, an Ultra-wideband (UWB) standard, a near-field magnetic induction (NFMI) standard, or a combination thereof. Devices may include one or more sensors and/or one or more indicators which may comprise an inertial measurement unit comprising of one or more of an accelerometer capable of sensing accelerations in one or two or all three spatial dimensions (x, y, z), an angular rate sensor or gyroscope capable of sensing rotation angle, angular speed, angular velocity, or rate of rotation about one or more rotation axes to detect yaw, pitch, or roll, one or more rate-integrating gyroscopes, one or more pressure sensors, one or more magnetometers, and further comprising one or more microphones to pick up sound from different directions or a same direction, or from inside an ear canal, one or more capacitive touch sensors, one or more optical sensors such as photodetectors, one or more light emitting diodes (LEDs), one or more ultrasound transmitters, one or more ultrasound receivers, one or more ultrasound transducers, one or more health biometrics sensors, one or more heart-rate sensors or monitors, or one or more blood-flow monitors, or a combination thereof. The headphone device may comprise one or more touch sensors, capacitive touch sensors, light emitting diodes, organic light emitting diodes, or display screens. The compliant gasket may have no leakage path from an enclosed air volume to an ambient environment. The compliant gasket may have a negligible leakage path from an enclosed air volume to an ambient environment. The compliant gasket may have leakage path from an enclosed air volume to an ambient environment that is capable of being dynamically tuned using mechanical pressure, pneumatic pressure, or an electric signal. The compliant gasket may have a negligible leakage path from an enclosed air volume to an ambient environment. The compliant gasket may have a leakage path from an enclosed air volume to an ambient environment that is capable of being dynamically tuned using mechanical pressure, pneumatic pressure, or an electric signal.

The earbud may comprise a wireless receiver, a wireless transmitter, or a wireless transceiver to receive or transmit signals via a wireless protocol, wherein the wireless receiver, wireless transmitter, or wireless transceiver are in compliance with a wireless communication standard or protocol. comprising a radio-frequency standard, a Bluetooth standard, a Third Generation Partnership Project (3GPP) standard, a Wireless-Fidelity (Wi-Fi) standard, an Institute of Electrical and Electronics Engineers (IEEE) standard, a Zigbee standard, a Fifth Generation (5G) New Radio (NR) standard, an Ultra-wideband (UWB) standard, a near-field magnetic induction (NFMI) standard, or a combination thereof. The earbud may comprise one or more sensors or one or more indicators, or a combination thereof. One or more sensors and/or indicators may include an inertial measurement unit comprising of one or more of an accelerometer capable of sensing accelerations in one or two or all three spatial dimensions (x, y, z), an angular rate sensor or gyroscope capable of sensing rotation angle, angular speed, angular velocity, or rate of rotation about one or more rotation axes to detect yaw, pitch, or roll, one or more rate-integrating gyroscopes, one or more pressure sensors, one or more magnetometers, and further comprising one or more microphones to pick up sound from different directions or a same direction, or from inside an ear canal, one or more capacitive touch sensors, one or more optical sensors such as photodetectors, one or more light emitting diodes (LEDs), one or more ultrasound transmitters, one or more ultrasound receivers, one or more ultrasound transducers, one or more health biometrics sensors, one or more heart-rate sensors or monitors, or one or more blood-flow monitors, or a combination thereof. The earbud may comprise one or more touch sensors, capacitive touch sensors, light emitting diodes, organic light emitting diodes, or display screens.

For a hearing aid, the driver may be disposed in the earbud. The driver may be disposed in the housing and acoustically coupled to the earbud such as with an acoustic tube filled with air. The hearing aid may comprise at least one microphone and a processor disposed in the housing to apply noise cancellation or reduction to the signal applied between the first electrode and the second electrode. At least a portion of the electrostatic acoustic transducer may be configured to function as a microphone. The electrostatic acoustic transducer may be configured to switch between a speaker function and a microphone function via time-division multiplexing. The hearing aid may comprise a wireless receiver, a wireless transmitter, or a wireless transceiver to receive or transmit signals via a wireless protocol, wherein the wireless receiver, wireless transmitter, or wireless transceiver are in compliance with a wireless communication standard or protocol comprising a radio-frequency standard, a Bluetooth standard, a Third Generation Partnership Project (3GPP) standard, a Wireless-Fidelity (Wi-Fi) standard, an Institute of Electrical and Electronics Engineers (IEEE) standard, a Zigbee standard, a Fifth Generation (5G) New Radio (NR) standard, an Ultra-wideband (UWB) standard, a near-field magnetic induction (NFMI) standard, or a combination thereof. The hearing aid may comprise one or more programmable filters, hardware accelerators, digital signal processors (DSP), timers, power management circuits, down sampling circuits, up sampling circuits, or electrically erasable programmable read-only memories (EEPROM), or a combination thereof. The hearing aid may comprise one or more sensors or one or more indicators, or combination thereof, comprising one or more of an accelerometer capable of sensing accelerations in one or two or all three spatial dimensions (x, y, z), an angular rate sensor or gyroscope capable of sensing rotation angle, angular speed, angular velocity, or rate of rotation about one or more rotation axes to detect yaw, pitch, or roll, one or more rate-integrating gyroscopes, one or more pressure sensors, one or more magnetometers, and further comprising one or more microphones to pick up sound from different directions or a same directions, or from inside an ear canal, one or more capacitive touch sensors, one or more optical sensors such as photodetectors, one or more light emitting diodes (LEDs), one or more ultrasound transmitters, one or more ultrasound receivers, one or more ultrasound transducers, one or more health biometrics sensors, one or more heart-rate sensors or monitors, or one or more blood-flow monitors, or a combination thereof. The hearing aid may comprise one or more touch sensors, capacitive touch sensors, light emitting diodes, organic light emitting diodes, or display screens, pushbuttons, switches, fitting connectors, volume control switches, knobs, sliders, and wheels.

For an audio processing system, the wireless signals may comprise an encoded audio signal received from a remote device, or an encoded audio signal to be transmitted to a remote device. The wireless receiver, the wireless transmitter, or the wireless transceiver may be in compliance with a wireless communication standard or protocol, wherein the wireless transceiver is in compliance with a radio-frequency standard, a Bluetooth standard, a Third Generation Partnership Project (3GPP) standard, a Wireless-Fidelity (Wi-Fi) standard, an Institute of Electrical and Electronics Engineers (IEEE) standard, a Zigbee standard, a Fifth Generation (5G) New Radio (NR) standard, an Ultra-wideband (UWB) standard, a near-field magnetic induction (NFMI) standard, or a combination thereof.

As used herein, the terms "circuit" or "circuitry" may refer to, be part of, or include an Application Specific Integrated Circuit (ASIC), an electronic circuit, a processor (shared, dedicated, or group), and/or memory (shared, dedicated, or group) that execute one or more software or firmware programs, a combinational logic circuit, a system on chip (SoC), and/or other suitable hardware components that provide the described functionality. In some embodiments, the circuitry may be implemented in, or functions associated with the circuitry may be implemented by, one or more software or firmware modules. In some embodiments, an ASIC may comprise a processor, and/or a processor may comprise an ASIC. In some embodiments, circuitry may include logic, at least partially operable in hardware. Embodiments described herein may be implemented into a system using any suitably configured hardware and/or software.

Although the claimed subject matter has been described with a certain degree of particularity, it should be recognized that elements thereof may be altered by persons skilled in the art without departing from the spirit and/or scope of claimed subject matter. It is believed that the subject matter pertaining to an electrostatic acoustic transducer utilized in a headphone device or an earbud and many of its attendant utilities will be understood by the forgoing description, and it will be apparent that various changes may be made in the form, construction and/or arrangement of the components thereof without departing from the scope and/or spirit of the claimed subject matter or without sacrificing all of its material advantages, the form herein before described being merely an explanatory embodiment thereof, and/or further without providing substantial change thereto. It is the intention of the claims to encompass and/or include such changes.

What is claimed is:

1. An earbud, comprising:

an earbud housing having a protrusion to fit into an external acoustic meatus or ear canal of a user; and a driver disposed in the earbud housing, wherein the driver comprises an electrostatic acoustic transducer comprising:

a substrate comprising a first material to function as a first electrode;

a dielectric layer coupled with the first material, wherein the dielectric layer has one or more cavities artificially formed therein; and a membrane coupled with the dielectric layer to cover the one or more cavities and to function as a second electrode;

wherein the electrostatic acoustic transducer generates an acoustic wave in response to an electrical signal applied between the first electrode and the second electrode, wherein the applied electrical signal comprises a direct-current (dc) bias voltage or one or more time-varying electrical signals, or a combination thereof.

2. The earbud of claim 1, wherein the cavities are generally cylindrical having a radius and depth selected such that the generated acoustic wave has a sound pressure level (SPL) of about 0 decibels (dB SPL) to about 90 dB SPL or about 115 dB SPL or greater when the applied signal is about 10 volts peak-to-peak or less.

3. The earbud of claim 2, wherein the electrostatic acoustic transducer is coupled to an enclosed volume of about two cubic centimeters or to an enclosed volume between about 0.1 cubic centimeters to about five cubic centimeters.

4. The earbud of claim 1, further comprising a compliant gasket or tip to achieve a flush mating between the protrusion and the external acoustic meatus or ear canal of a user or an air tube.

5. The earbud device of claim 4, wherein the compliant gasket comprises silicone, gel, an elastomer, a viscoelastic polymer, acrylic, vinyl, rubber, polyethylene, polymethyl methacrylate, polyurethane, viscoelastic urethane polymer, SORBOTHANE, or a combination thereof.

6. The earbud of claim 4, wherein the compliant gasket has no leakage or substantially no leakage from an enclosed air volume to an ambient environment.

7. The earbud of claim 1, further comprising at least one microphone and a processor disposed in the earbud housing to apply noise cancellation to the signal applied between the first electrode and the second electrode.

8. The earbud of claim 7, wherein the at least one microphone comprises one or more additional electrostatic acoustic transducers configured to detect an acoustic wave impinging on the at least one microphone.

9. The earbud of claim 1, wherein at least a portion of the electrostatic acoustic transducer is configured to function as a microphone.

10. The earbud of claim 1, wherein the electrostatic acoustic transducer is configured to switch between a speaker function and a microphone function via time-division multiplexing.

11. The earbud of claim 1, further comprising an additional earbud comprising an additional earbud housing and at least one additional driver in the additional earbud housing, wherein the at least one additional driver comprises an additional electrostatic acoustic transducer, and wherein the earbud housing and the additional earbud housing are connected via a wired connection or via a wireless connection.

12. The earbud of claim 1, further comprising a wireless receiver, a wireless transmitter, or a wireless transceiver to receive or transmit signals via a wireless protocol, wherein the wireless receiver, wireless transmitter, or wireless transceiver are in compliance with a wireless communication standard or protocol.

13. The earbud of claim 1, further comprising a battery and a recharging port to allow the battery to be recharged from a wired power source or battery pack, or a wireless charging system to allow the battery to be recharged from a wireless power source, or a combination thereof.

14. The earbud of claim 1, further comprising one or more sensors or one or more indicators, or a combination thereof.

15. The earbud of claim 1, further comprising one or more processors disposed in the at least one earbud housing or in at least one or more additional earbud housings, or a combination thereof, to couple with at least one or more processors disposed in a remote device such as a computer, a cellular phone, a smart phone, a smart watch, a tablet, or an electronic book reader, or a combination thereof, to control the earbud or to control one or more functions of the remote device, via a wired connection or a wireless connection, or a combination thereof.

16. An electrostatic acoustic transducer, comprising:

a substrate comprising a first material to function as a first electrode;

a dielectric layer coupled with the first material, wherein the dielectric layer has one or more cavities artificially formed therein; and a membrane coupled with the dielectric layer to cover one or more of the one or more cavities and to function as a second electrode;

wherein the electrostatic acoustic transducer generates an acoustic wave in response to an electrical signal applied between the first electrode and the second electrode, wherein the applied electrical signal comprises a direct-current (dc) bias voltage or one or more time-varying electrical signals, or a combination thereof, wherein the electrostatic acoustic transducer is configured to be used in an earbud to produce sound audible to human ears.

17. The electrostatic acoustic transducer of claim 16, wherein the cavities are generally cylindrical having a radius and depth selected such that the generated acoustic wave has a sound pressure level (SPL) of about 0 decibels (dB SPL) to about 90 dB SPL or about 115 dB SPL or greater when the applied signal is about 10 volts peak-to-peak or less.

18. The electrostatic acoustic transducer of claim 16, wherein the electrostatic acoustic transducer is coupled to an enclosed volume of about two cubic centimeters or to an enclosed volume between about 0.1 cubic centimeters to about five cubic centimeters.

19. The electrostatic acoustic transducer of claim 16, wherein the dielectric layer has a density of the cavities of about 1 to about 100 cavities per square millimeter.

20. The electrostatic acoustic transducer of claim 16, wherein the substrate comprises doped silicon, highly doped silicon, electrically-conducting silicon, indium tin oxide coated polyethylene terephthalate (ITO-PET), indium tin oxide coated glass (silicon dioxide), metal coated glass, metal coated silicon, metal-coated polysilicon, or metal-coated silicon nitride.

21. The electrostatic acoustic transducer of claim 16, wherein the dielectric layer comprises silicon dioxide, intrinsic silicon, polysilicon, silicon nitride, aluminum oxide, a polymer, polydimethylsiloxane (PDMS), or a combination thereof.

22. The electrostatic acoustic transducer of claim 16, wherein the membrane comprises gold, silver, aluminum, chrome, copper, nickel, single-layer graphene, multi-layer graphene, or a combination thereof, or a metal and polymer composite, or parylene-gold.

23. The electrostatic acoustic transducer of claim 16, wherein at least one or more of the one or more cavities has a sloping sidewall.

24. The electrostatic acoustic transducer of claim 16, wherein at least one or more of the one or more cavities are connected to each other via one or more shared walls between one or more adjacent cavities.

25. The electrostatic acoustic transducer of claim 16, wherein the one or more cavities have varying sizes, radii, or depths, or a combination thereof, in the dielectric layer, or across two or more of the dielectric layers on a same substrate die or across two or more substrate dies.

26. The electrostatic acoustic transducer of claim 16, further comprising an insulator layer covering at least a portion of a sidewall, or a bottom of at least one or more of the one or more cavities, or on top of the dielectric layer contacting the membrane, or a combination thereof.

27. The electrostatic acoustic transducer of claim 16, wherein the ratio of generated acoustic sound pressure to an input electrical voltage is substantially uniform in a frequency range of about 10 Hertz (Hz) to about 20 kilohertz (kHz) when the electrostatic acoustic transducer is driven with an electrical signal in the frequency range and coupled to a volume of about two cubic centimeters or to a volume between about 0.1 cubic centimeters to about five cubic centimeters.

28. The electrostatic acoustic transducer of claim 16, further comprising an additional membrane to cover one or more of the one or more cavities, wherein the membrane and the additional membrane have different thicknesses.

29. The electrostatic acoustic transducer of claim 16, wherein the substrate comprises a CMOS substrate die having one or more digital signal processing circuitry, analog signal processing circuitry, sense circuitry, drive circuitry, or power circuitry, or a combination thereof, fabricated on the CMOS substrate die.

30. The electrostatic acoustic transducer of claim 29, wherein the dielectric layer is disposed on two sides of the CMOS substrate die or on two or more of the CMOS substrate dies, and one or more membranes are coupled with dielectric layers on both sides to cover one or more of the one or more cavities and to function as the second electrode or a third electrode.

31. The electrostatic acoustic transducer of claim 16, wherein the electrostatic acoustic transducer generates an electrical signal across the first electrode and the second electrode in response to an acoustic wave impinging on the membrane.

32. The electrostatic acoustic transducer of claim 16, wherein electrostatic acoustic transducer is capable of operating when the applied electrical signal is about 10 volts peak-to-peak or less.

33. The electrostatic acoustic transducer of claim 16, further comprising two or more membranes that are capable of being addressed independently or simultaneously.

34. The electrostatic acoustic transducer of claim 16, further comprising a meter or other sensor to detect a change in capacitance or a deflection of the membrane in response to an acoustic wave impinging on the membrane.

* * * * *